US008017552B2

(12) United States Patent
Kariya

(10) Patent No.: US 8,017,552 B2
(45) Date of Patent: Sep. 13, 2011

(54) HEAT-SENSITIVE TRANSFER SHEET AND IMAGE-FORMATION METHOD

(75) Inventor: Toshihiro Kariya, Ashigarakami-gun (JP)

(73) Assignee: FUJIFILM Corporation, Tokyo (JP)

( * ) Notice: Subject to any disclaimer, the term of this patent is extended or adjusted under 35 U.S.C. 154(b) by 838 days.

(21) Appl. No.: 12/058,571

(22) Filed: Mar. 28, 2008

(65) Prior Publication Data

US 2008/0248949 A1 Oct. 9, 2008

(30) Foreign Application Priority Data

Mar. 29, 2007 (JP) ..... 2007-089444

(51) Int. Cl.
*B41M 5/035* (2006.01)
*B41M 5/50* (2006.01)

(52) U.S. Cl. ..... 503/227; 428/32.76; 428/32.81

(58) Field of Classification Search ..... None
See application file for complete search history.

(56) References Cited

U.S. PATENT DOCUMENTS 5,672,561 A 9/1997 Shinohara

FOREIGN PATENT DOCUMENTS

| | | |
|---|---|---|
| JP | 60-34898 | 2/1985 |
| JP | 61-258792 | 11/1986 |
| JP | 2-196692 | 8/1990 |
| JP | 8-2126 | 1/1996 |

*Primary Examiner* — Bruce H Hess
(74) *Attorney, Agent, or Firm* — Sughrue Mion, PLLC

(57) ABSTRACT

A heat-sensitive transfer sheet having on a support at least one thermal transfer layer of a yellow color, at least one thermal transfer layer of a magenta color, at least one thermal transfer layer of a cyan color and at least one releasable, thermally-transferable protective layer, wherein the thermal transfer layer of each color contains a release agent and contents of the release agent in the thermal transfer layers are reduced in a frame-sequential mode.

6 Claims, 1 Drawing Sheet

HEAT-SENSITIVE TRANSFER SHEET AND IMAGE-FORMATION METHOD

FIELD OF THE INVENTION

The present invention relates to a heat-sensitive transfer sheet and, more particularly, to a heat-sensitive transfer sheet that has a thermal transfer layer on a support, can stably keep up good capability of peeling off an image-receiving sheet without being affected by properties of a support in the image-receiving sheet, and has excellent running stability, and to a method of an image formation.

BACKGROUND OF THE INVENTION

Various thermal transfer recording methods have been known so far. Among these methods, dye diffusion transfer recording systems attract attention as a process that can produce a color hard copy having an image quality closest to that of silver halide photography (see, for example, "Joho Kiroku (Hard Copy) to Sono Zairyo no Shintenkai (Information Recording (Hard Copy) and New Development of Recording Materials)" published by Toray Research Center Inc., 1993, pp. 241-285; and "Printer Zairyo no Kaihatsu (Development of Printer Materials)" published by CMC Publishing Co., Ltd., 1995, p. 180). Moreover, this system has advantages over silver halide photography: it is a dry system, it enables direct visualization from digital data, it makes reproduction simple, and the like.

In this dye diffusion transfer recording system, a heat-sensitive transfer sheet (hereinafter also referred to as an ink sheet) containing dyes is superposed on a heat-sensitive transfer image-receiving sheet (hereinafter also referred to as an image-receiving sheet), and then the ink sheet is heated by a thermal head whose exothermic action is controlled by electric signals, in order to transfer the dyes contained in the ink sheet to the image-receiving sheet, thereby recording an image information. Three colors: cyan, magenta, and yellow, or four colors which consists of the three colors and black, are used for recording a color image by overlapping one color to other, thereby enabling transferring and recording a color image having continuous gradation for color densities.

It is preferable that thermal transfer layers of individual colors are formed repeatedly in a frame sequential mode on one and the same support. In addition, part of thermal transfer layers may be ink layers of heat-fusion transfer type. Furthermore, a protective layer for covering and protecting printed images through thermal transfer onto images after printing can also be formed on the same support in addition to the thermal transfer layers.

The thermal transfer layers can be provided in any manner as long as it is appropriate to the intended purpose. For instance, it is possible to provide thermal transfer layers of color hues other than general yellow, magenta, cyan or black hue.

In this dye diffusion transfer recording system, a heat-sensitive transfer sheet containing dyes is superposed on a heat-sensitive transfer image-receiving sheet (hereinafter also referred to as an image-receiving sheet), and then the ink sheet is heated by a thermal head whose exothermic action is controlled by electric signals, in order to transfer the dyes contained in the ink sheet to the image-receiving sheet, thereby recording an image information. Three colors: cyan, magenta, and yellow, are used for recording a color image by overlapping one color to other, thereby enabling transferring and recording a color image having continuous gradation for color densities.

However, utilization of the heat-sensitive transfer recording methods presented drawbacks that fusion bonding or sticking occurred between an image-receiving sheet for heat-sensitive transfer recording and a heat-sensitive transfer sheet, wrinkles developed in a heat-sensitive transfer sheet by heat or pressure applied to the sheet at the time of thermal transfer recording, and so on.

As methods for preventing image-receiving paper from suffering heat-fusion bonding on the color-material reception layer side, JP-A-60-34898 ("JP-A" means unexamined published Japanese patent application) discloses incorporation of a dye-permeable release agent into a receptive layer (image-receiving layer), and JP-A-61-258792 discloses formation of a thin layer of cured silicone resin on a dyed resin layer.

As disclosed in JP-A-2-196692 and JP-A-8-2126, there is known the method of resolving heat-fusion bonding or sticking troubles occurring between an image-receiving sheet for thermal transfer recording and a heat-sensitive transfer sheet by incorporation of a silicone resin into the heat-sensitive transfer sheet. However, there is a trade-off relation that, when a silicone resin in a higher amount is incorporated into a heat-sensitive transfer sheet, the heat-sensitive transfer sheet is more likely to develop wrinkles (ribbon wrinkles). Solution of this trade-off problem from the material point of view has not been found yet.

In addition, incorporation of a high amount of silicone resin into a cyan thermal transfer layer in particular causes another problem of degrading surface conditions of the coating layer and making it difficult for the printed image to have sufficient density.

SUMMARY OF THE INVENTION

The present invention resides in a heat-sensitive transfer sheet having on a support at least one thermal transfer layer of a yellow color, at least one thermal transfer layer of a magenta color, at least one thermal transfer layer of a cyan color and at least one releasable, thermally-transferable protective layer, wherein the thermal transfer layer of each color contains a release agent and contents of the release agent in the thermal transfer layers are reduced in a frame-sequential mode.

Further, the present invention resides in a heat-sensitive transfer sheet having on a support at least one thermal transfer layer of a yellow color, at least one thermal transfer layer of a magenta color, at least one thermal transfer layer of a cyan color and at least one releasable, thermally-transferable protective layer in a frame-sequential mode where the thermal transfer layer of a yellow color, the thermal transfer layer of a magenta color, the thermal transfer layer of a cyan color and the thermally-transferable protective layer are aligned in order of mention, wherein release agent contents in the yellow thermal transfer layer, the magenta thermal transfer layer and the cyan thermal transfer layer become lower in order of mention.

Further, the present invention resides in an image formation method in which images are formed in a state that the heat-sensitive transfer sheet is superposed upon a heat-sensitive transfer image-receiving sheet having at least one dye-receiving layer on a support.

Other and further features and advantages of the invention will appear more fully from the following description, appropriately referring to the accompanying drawings.

DETAILED DESCRIPTION OF THE INVENTION

Figure 1:
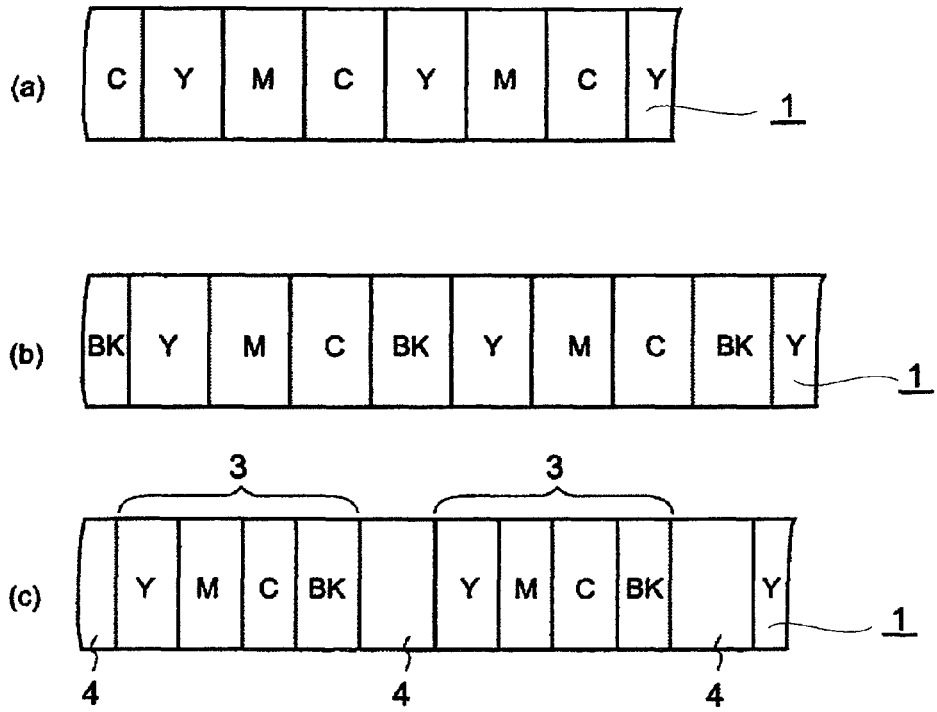
FIGS. 1 (*a*) to (*c*) are plane figures showing one embodiment of the heat-sensitive transfer sheet.

The present invention provides the following means:

(1) A heat-sensitive transfer sheet having on a support at least one thermal transfer layer of a yellow color, at least one thermal transfer layer of a magenta color, at least one thermal transfer layer of a cyan color and at least one releasable, thermally-transferable protective layer, wherein the thermal transfer layer of each color contains a release agent and contents of the release agent in the thermal transfer layers are reduced in a frame-sequential mode.

(2) A heat-sensitive transfer sheet having on a support at least one thermal transfer layer of a yellow color, at least one thermal transfer layer of a magenta color, at least one thermal transfer layer of a cyan color and at least one releasable, thermally-transferable protective layer in a frame-sequential mode where the thermal transfer layer of a yellow color, the thermal transfer layer of a magenta color, the thermal transfer layer of a cyan color and the thermally-transferable protective layer are aligned in order of mention, wherein release agent contents in the yellow thermal transfer layer, the magenta thermal transfer layer and the cyan thermal transfer layer become lower in order of mention.

(3) An image formation method in which images are formed in a state that the heat-sensitive transfer sheet as described in item (1) or (2) is superposed upon a heat-sensitive transfer image-receiving sheet having at least one dye-receiving layer on a support.

(4) The image formation method as described in item (3), wherein the heat-sensitive transfer image-receiving sheet has at least one dye-receiving layer on a support, and further has at least one heat insulation layer containing hollow polymer particles and a hydrophilic polymer between the dye-receiving layer and the support.

The heat-sensitive transfer sheets (ink sheets) of the present invention are described below.

Noticing that silicone is transferred from the heat-sensitive transfer sheet to each of colors at the time of heat-sensitive transfer recording, the present inventors have found that previous problems as described above can be dissolved without deteriorating sliding properties, even though a content of silicone is reduced in a frame-sequential mode in the heat-sensitive transfer sheet.

Examples of a release agent usable in the present invention include various kinds of wax, such as zinc stearate, stearic acid amide, carnauba wax, montan wax, polyethylene wax and paraffin wax, higher aliphatic acid alcohol, organopolysiloxanes, anionic surfactants, cationic surfactants, amphoteric surfactants, nonionic surfactants, fluorine-containing surfactants, organic carboxylic acids and derivatives thereof, and organic or inorganic fine particles.

More specifically, the preferred are materials having excellent releasing properties, such as wax and fluorocarbon resin, or resins which have relatively high softening temperatures and are not melted by heat of a thermal head, such as cellulose resins, acrylic resins, polyurethane resins, polyvinyl acetal resins, acryl vinyl ether resins, maleic anhydride resins, fluorocarbon resins and the above-recited resins containing thermal release agents, such as wax. And silicone oils, silicone resins or silicone-modified resins are preferable by far.

As the silicone oil, straight silicone oil and modified silicone oil or their hardened products may be used.

Examples of the straight silicone oil include dimethylsilicone oil, methylphenylsilicone oil and methyl hydrogen silicone oil. Examples of the dimethylsilicone oil include KF96-10, KF96-100, KF96-1000, KF96H-10000, KF96H-12500 and KF96H-100000 (trade names, manufactured by Shin-Etsu Chemical Co., Ltd.). Examples of the methylphenylsilicone oil include KF50-100, KF54 and KF56 (trade names, manufactured by Shin-Etsu Chemical Co., Ltd.).

The modified silicone oil may be classified into reactive silicone oils and non-reactive silicone oils. Examples of the reactive silicone oils include amino-modified, epoxy-modified, carboxyl-modified, hydroxy-modified, methacryl-modified, mercapto-modified, phenol-modified or one-terminal reactive/hetero-functional group-modified silicone oils. Examples of the amino-modified silicone oil include KF-393, KF-857, KF-858, X-22-3680, X-22-3801C, KF-8010, X-22-161A and KF-8012 (trade names, manufactured by Shin-Etsu Chemical Co., Ltd.). Examples of the epoxy-modified silicone oil include KF-100T, KF-101, KF-60-164, KF-103, X-22-343 and X-22-3000T (trade names, manufactured by Shin-Etsu Chemical Co., Ltd.). Examples of the carboxyl-modified silicone oil include X-22-162C (trade name, manufactured by Shin-Etsu Chemical Co., Ltd.). Examples of the hydroxy-modified silicone oil include X-22-160AS, KF-6001, KF-6002, KF-6003, X-22-170DX, X-22-176DX, X-22-176D and X-22-176DF (trade names, manufactured by Shin-Etsu Chemical Co., Ltd.). Examples of the methacryl-modified silicone oil include X-22-164A, X-22-164C, X-24-8201, X-22-174D and X-22-2426 (trade names, manufactured by Shin-Etsu Chemical Co., Ltd.).

Reactive silicone oils may be hardened upon use, and are classified into a reaction-curable type, photocurable type, catalyst-curable type, and the like. Among these types, the reaction-curable type silicone oil is particularly preferable. As the reaction-curable type silicone oil, products obtained by reacting an amino-modified silicone oil with an epoxy-modified silicone oil and then curing are preferable. Also, examples of the catalyst-curable type or photocurable type silicone oil include KS-705F-PS, KS-705F-PS-1 and KS-770-PL-3 (trade names, catalyst-curable silicone oils, manufactured by Shin-Etsu Chemical Co., Ltd.) and KS-720 and KS-774-PL-3 (trade names, photocurable silicone oils, manufactured by Shin-Etsu Chemical Co., Ltd.).

Examples of the non-reactive silicone oil include polyether-modified, methylstyryl-modified, alkyl-modified, higher fatty acid ester-modified, hydrophilic special-modified, higher alkoxy-modified or fluorine-modified silicone oils. Examples of the polyether-modified silicone oil include KF-6012 (trade name, manufactured by Shin-Etsu Chemical Co., Ltd.) and examples of the methylstyryl-modified silicone oil include 24-510 (trade name, manufactured by Shin-Etsu Chemical Co., Ltd.). Modified silicones represented by any one of the following Formulae 1 to 3 may also be used.

Formula 1

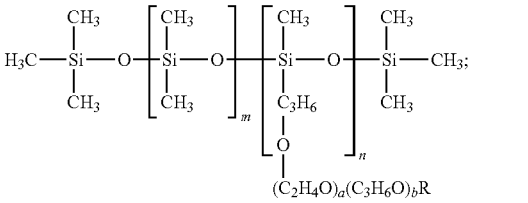

In the Formula 1, R represents a hydrogen atom, a straight-chain or branched alkyl group which may be substituted with an aryl or cycloalkyl group. m and n respectively denote an integer of 2,000 or less, and a and b respectively denote an integer of 30 or less.

Formula 2

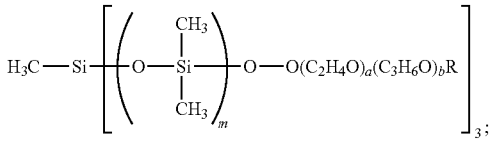

In the Formula 2, R represents a hydrogen atom, a straight-chain or branched alkyl group which may be substituted with an aryl or cycloalkyl group. m denotes an integer of 2,000 or less, and a and b respectively denote an integer of 30 or less.

Formula 3

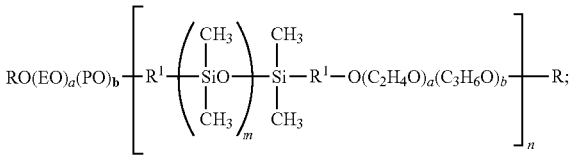

In the Formula 3, R represents a hydrogen atom, a straight-chain or branched alkyl group which may be substituted with an aryl or cycloalkyl group. m and n respectively denote an integer of 2,000 or less, and a and b respectively denote an integer of 30 or less. $R^1$ represents a single bond or a divalent linking group, E represents an ethylene group which may be further substituted, and P represents a propylene group which may be further substituted.

Silicone oils such as those mentioned above are described in "SILICONE HANDBOOK" (The Nikkan Kogyo Shimbun, Ltd.) and the technologies described in each publication of JP-A-8-108636 and JP-A-2002-264543 may be preferably used as the technologies to cure the curable type silicone oils.

The term "silicone resins" as used in the present invention is intended to include organopolysiloxanes having siloxane links and alkyl groups, such as methyl groups, attached to silicon atoms and being in a resinous or solid state at ordinary temperature. Examples of organopolysiloxanes usable in the present invention are represented by the following chemical formula.

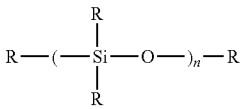

(R represents a hydrogen atom, an optionally substituted alkyl group, or an optionally substituted aryl group. n represents an integer of 0 or more).

Examples of a silicone-modified resin usable in the present invention include modified polysiloxane resins obtained by subjecting alkyl groups in the foregoing organopolysiloxanes to various modifications, such as epoxy modification, olefin modification, ether modification, alcohol modification, fluorine modification, amino modification, mercapto modification and carboxyl modification, and silicone-modified resins obtained by partly modifying urethane resins, acrylic resins and polyester resins with the foregoing polysiloxanes (wherein silicone moiety content is preferably from 5 to 40 mass % based on the modified resin). Additionally, the following are examples of structural formulae of the modified polysiloxane resins as specified above.

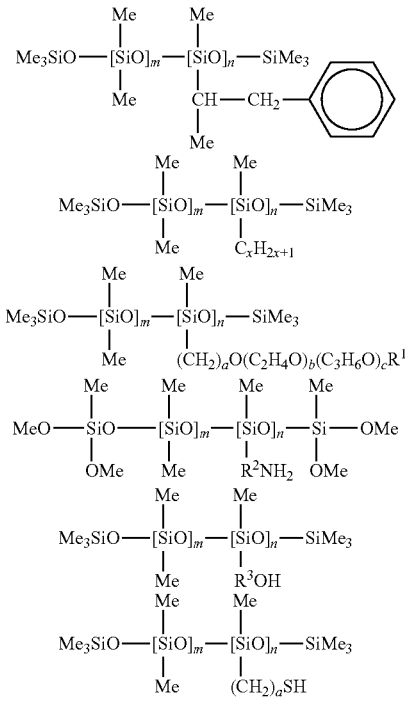

In the above chemical formulae, m, n, a, b, c and x are each an integer of 0 or above except for the case where m and n are zero at the same time. $R^1$ represents an alkyl group, and $R^2$ and $R^3$ are each a divalent linkage group. In addition, Me stands for a methyl group.

In the present invention, thermoplastic resins containing silicones in their side chains can also be used.

Silicone oil, silicone resin and silicone-modified resin usable in the present invention are incorporated into dye-layer ink. And the content of such silicones is preferably from 0.1 to 10 mass %, more preferably from 1 to 3 mass %, based on the total solids in a state of being formed as a dye layer in the dye-layer ink.

It is a feature of the present invention that the contents of the silicone oil, silicone resin and silicone-modified resin used in dye ink layers become lower in a frame-sequential mode. Alternatively, their contents in the thermal transfer layer of a yellow color, the thermal transfer layer of a magenta color and the thermal transfer layer of a cyan color become lower in order of mention. It is preferred to control the content of silicone in a proportion such that assuming that the content of the former is 100, the content of the latter is 90 or less, as exemplified below:

Assuming that the content of silicone in a yellow dye ink layer is 100, the content of silicone in a magenta dye ink layer is 90 or less, and assuming that the content of silicone in the magenta dye ink layer is 100, the content of silicone in a cyan dye ink layer is 90 or less.

Figure 2:
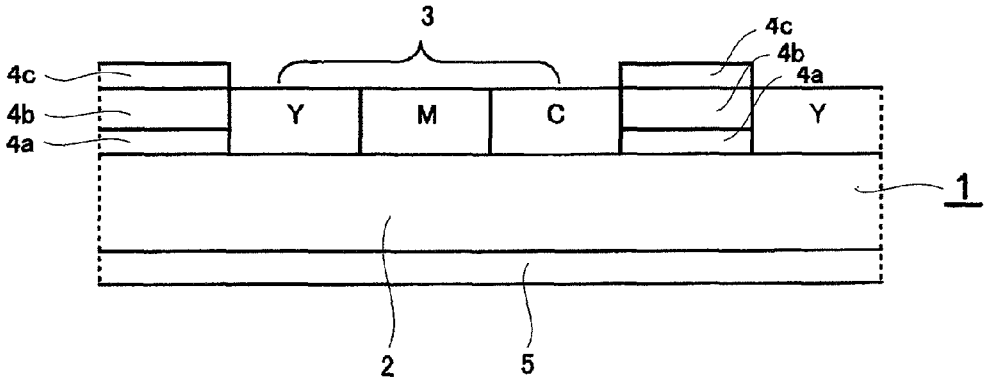
FIG. 2 is a cross-sectional view showing one embodiment of the heat-sensitive transfer sheet.

The heat-sensitive transfer sheet of the present invention has at least one yellow thermal transfer layer, at least one magenta thermal transfer layer, at least one cyan thermal transfer layer and a heat transferable protective layer that is releasable, each of the layers being disposed on one surface of the support. Each of the color thermal transfer layers may be coated in an arbitrary order. However, it is preferred to coat a yellow thermal transfer layer, a magenta thermal transfer layer and a cyan thermal transfer layer in this order. In addition to these layers, a black thermal transfer layer may be disposed. In FIGS. 1(*a*) to 1(*c*), there is shown as an example an embodiment such that a yellow thermal transfer layer (Y), a magenta thermal transfer layer (M), a cyan thermal transfer layer (C) and a black thermal transfer layer (BK) are coated separately in a frame-sequential mode. Further in FIG. 2, there is shown as another example an embodiment such that a yellow thermal transfer layer, a magenta thermal transfer layer and a cyan thermal transfer layer are coated separately in a frame-sequential mode. In figures, 1 stands for a heat-sensitive transfer sheet. 2 stands for a substrate. 3 stands for a thermal transfer layer (a dye layer or an ink layer). 4 stands for a transferable protective layer lamination. The aforesaid transferable protective layer lamination 4 may be composed of, for example, a release layer 4*a*, a protective layer 4*b* and an adhesion layer 4*c* as shown in FIG. 2. 5 stands for a reverse surface layer (a back layer).

The term "forming layers in a frame-sequential mode" as used herein means forming heat-sensitive transfer dye layers each having a different hue and/or function layers in the longitudinal direction on the support of the heat-sensitive transfer sheet, by applying them separately in order.

Examples include the case in which a yellow heat transfer layer, a magenta heat transfer layer, and a cyan heat transfer layer are formed in this order in the longitudinal direction on the support.

Further, any arrangement of these heat-sensitive transfer dye layers can be employed, but it is preferred that a yellow heat transfer layer, a magenta heat transfer layer, and a cyan heat transfer layer be arranged sequentially in this order on the support.

Arrangement of the heat transfer layers of different hues in the present invention is not limited to the above, and a black or other heat transfer layer of a hue other than yellow, magenta, and cyan can be employed as required. Further, it is preferred to form a transferable protective layer (a transferable protective layer laminate) as a function layer, after forming the yellow heat transfer layer, the magenta heat transfer layer, and the cyan heat transfer layer in the longitudinal direction on the support, as mentioned above.

Further, the heat-sensitive transfer sheet that is used in the present invention is characterized in that each of the color thermal transfer layers contains a release agent and a content of the release agent reduces in a frame-sequential mode. Advantages obtained by such characteristic compositions are explained below.

The release agent in each of the color thermal transfer layers is partially transferred to an image-receiving sheet at the time of thermal transfer. Consequently, as the transfer proceeds in a frame-sequential mode, a content of the release agent at the surface of the image-receiving sheet is increasing. Therefore, reduction in the content of the release agent in a frame-sequential mode enables to maintain a release property between the heat-sensitive transfer sheet and the image-receiving sheet in a suitable range. In the case where the release property is insufficient, a separation between the heat-sensitive transfer sheet and the image-receiving sheet after thermal transfer becomes difficult, thereby raising problems such as sticking. On the other hand, in the case where the release property is more than enough, ribbon wrinkles are apt to occur. The term of ribbon wrinkles means that wrinkles occur during printing in a heat-sensitive transfer sheet that is also called an ink ribbon, which results in print failure. Occurrence of the ribbon wrinkles is mainly caused by insufficiency in abrasion force between the heat-sensitive transfer sheet and the image-receiving sheet, which result in easiness of sliding. In other words, when the release property is excessively high, abrasion force becomes insufficient, which results in occurrence of the ribbon wrinkles. In view of the aforementioned cause, it is necessary to maintain the release property in a definite range. Consequently, reduction in the content of the release agent in a frame-sequential mode enables to maintain the release property in a suitable range. In the present invention, it is necessary that a content of the release agent on and after the second of each of the color thermal transfer layers is lowered than that of a color thermal transfer layer just prior to aforesaid color thermal transfer layer, with a preferable content being in the range of from 40% to 90%, more preferably from 50% to 80%.

Hereinafter, the dye layer ink for use in the present invention will be explained.

(Dye Ink)

The dye layer ink contains at least a sublimation type dye and a binder resin. It is a preferable embodiment of the present invention that the ink may contains organic or inorganic finely divided powder in accordance with necessity.

The dye for use in the present invention is not particularly limited, so far as the dye is able to diffuse by heat, able to be incorporated in a sublimation type heat-sensitive transfer sheet, and able to transfer by heat from the sublimation type heat-sensitive transfer sheet to a heat-sensitive transfer image-receiving sheet. Accordingly, as the dye that is used for the heat-sensitive transfer sheet, ordinarily used dyes or known dyes can be effectively used.

Preferable examples of the dye include diarylmethane-series dyes; triarylmethane-series dyes; thiazole-series dyes; methine-series dyes such as merocyanine; azomethine-series dyes typically exemplified by indoaniline, acetophenoneazomethine, pyrazoloazomethine, imidazole azomethine, imidazo azomethine, and pyridone azomethine; xanthene-series dyes; oxazine-series dyes; cyanomethylene-series dyes typically exemplified by dicyanostyrene, and tricyanostyrene; thazine-series dyes; azine-series dyes; acridine-series dyes; benzene azo-series dyes; azo-series dye such as pyridone azo, thiophene azo, isothiazole azo, pyrol azo, pyralazo, imidazole azo, thiadiazole azo, triazole azo, disazo; spiropyran-series dyes; indolinospiropyran-series dyes; fluoran-series dyes; rhodaminelactam-series dyes; naphthoquinone-series dyes; anthraquinone-series dyes; and quinophthalon-series dyes.

Specific examples of the yellow dyes include Disperse Yellow 231, Disperse Yellow 201 and Solvent Yellow 93. Specific examples of the magenta dyes include Disperse Violet 26, Disperse Red 60, and Solvent Red 19. Specific examples of the cyan dyes include Solvent Blue 63, Solvent Blue 36, Disperse Blue 354 and Disperse Blue 35. As a matter of course, it is also possible to use suitable dyes other than these dyes as exemplified above.

Further, dyes each having a different hue from each other as described above may be arbitrarily combined together. For instance, a black hue can be obtained from a combination of dyes.

Dyes that can be preferably used in the present invention are explained in detail below.

In the thermal transfer layer (hereinafter also referred to as a dye layer) of the ink sheet that is used in the present invention, known dyes that have been used from the past may be used as a yellow dye. Of these dyes, it is preferred to use at least one dye represented by formula (Y1) or (Y2) set forth below. However, the yellow dye that can be used in the present invention is not limited to these dyes.

Formula (Y1)

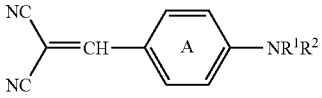

In the formula (Y1), the ring A represents a substituted or unsubstituted benzene ring, and $R^1$ and $R^2$, which are mutually independent, each represent a hydrogen atom, a substituted or unsubstituted alkyl group, a substituted or unsubstituted alkenyl group or a substituted or unsubstituted aryl group.

Each of the groups represented by $R^1$ and $R^2$ may further have a substituent. Examples of a substituent by which the ring A, $R^1$ and $R^2$ each may be substituted include a halogen atom, an unsaturated hydrocarbon group, a cycloalkyl group, an aryl group, a heterocyclic group, an alkoxyl group, an acyloxy group, a carbamoyloxy group, an alkoxycarbonyloxy group, an aryloxycarbonyloxy group, an amino group, an acylamino group, an aminocarbonylamino group, an alkoxycarbonylamino group, a sulfamoylamino group, an alkyl- or arylsulfonylamino group, an alkylthio group, a sulfamoyl group, an alkyl group, an arylsulfinyl group, an arylsulfonyl group, an acyl group, an aryloxycarbonyl group, an alkoxycarbonyl group, a carbamoyl group, an aryl- or heterocyclylazo group, an imido group, a hydroxyl group, a cyano group, a nitro group, a sulfo group and a carboxyl group.

Examples of a preferred combination of the ring A and the substituents $R^1$ and $R^2$ in a dye represented by the formula (Y1) include combinations wherein the ring A is a substituted or unsubstituted benzene ring, $R^1$ is a substituted or unsubstituted alkyl group having 1 to 8 carbon atoms, an allyl group or a substituted or unsubstituted aryl group having 6 to 10 carbon atoms, and $R^2$ is a substituted or unsubstituted alkyl group having 1 to 8 carbon atoms, an allyl group or a substituted or unsubstituted aryl group having 6 to 10 carbon atoms.

In more preferred combinations of the ring A and the substituents $R^1$ and $R^2$, the ring A is a substituted or unsubstituted benzene ring, $R^1$ is a substituted or unsubstituted alkyl group, an allyl group or a substituted or unsubstituted phenyl group, and $R^2$ is a substituted or unsubstituted alkyl group, an allyl group or a substituted or unsubstituted phenyl group.

In the most preferred combinations, the ring A is a benzene ring substituted by a methyl group, $R^1$ is a substituted or unsubstituted alkyl group having 1 to 4 carbon atoms, and $R^2$ is a substituted alkyl group having 1 to 4 carbon atoms. Examples of a group suitable as the substituent by which the alkyl group of $R^2$ may further be substituted include an alkoxy group having 1 to 4 carbon atoms, an aryl group having 6 to 20 carbon atoms, an aryloxy group having 6 to 20 carbon atoms, an alkoxycarbonyl group whose alkoxy moiety contains 1 to 4 carbon atoms, and a substituted or unsubstituted aryloxycarbonyl group whose aryl moiety contains 6 to 20 carbon atoms.

Specific examples of yellow dyes represented by formula (Y1) that are used in the present invention are shown below. However, the aforementioned yellow dyes of formula (Y1) are not limited to these specific examples below.

Y1-1

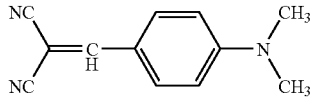

Y1-2

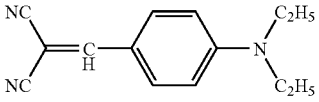

Y1-3

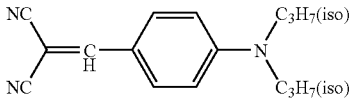

Y1-4

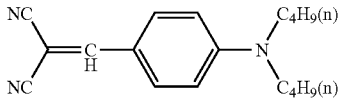

Y1-5

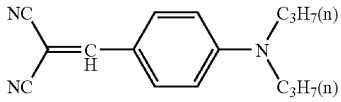

Y1-6

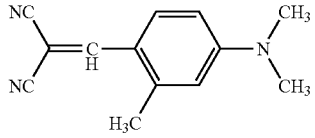

Y1-7

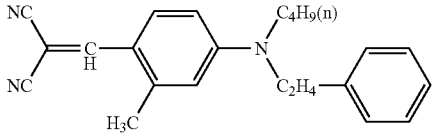

Y1-8

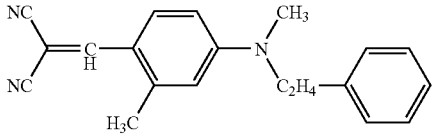

Y1-9

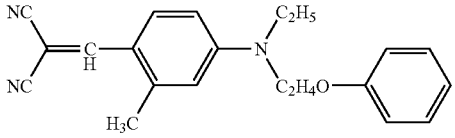

Y1-10

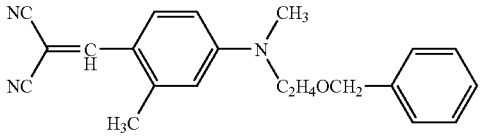

Y1-11

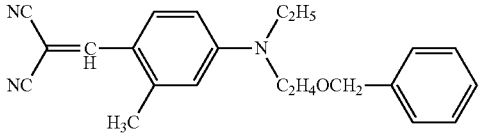

Y1-12

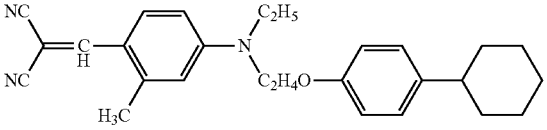

-continued

Y1-13

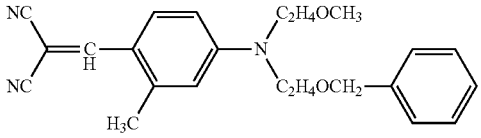

Y1-14

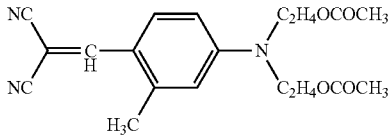

Next, the dye represented by formula (Y2) is explained in detail below.

Formula (Y2)

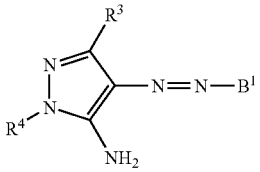

In the formula (Y2), $B^1$ represents a substituted or unsubstituted aryl group or a substituted or unsubstituted aromatic heterocyclic group, $R^3$ represents a substituted or unsubstituted alkyl group, and $R^4$ represents a substituted or unsubstituted alkyl group or a substituted or unsubstituted aryl group.

Each group of $R^3$ and $R^4$ may further have a substituent. Examples of a substituent by which each group of $B^1$, $R^3$ and $R^4$ may be substituted include the same substituents as the ring A and each group of $R^1$ and $R^2$ in the formula (Y1) may have.

The aryl group of $B^1$ is preferably a phenyl group which may have a substituent.

Examples of a preferred combination of the substituents $B^1$, $R^3$ and $R^4$ in a dye represented by the formula (Y2) include combinations wherein $B^1$ is a substituted or unsubstituted aryl group having 6 to 10 carbon atoms, a substituted or unsubstituted pyrazolyl group or a substituted or unsubstituted thiadiazolyl group, $R^3$ is a substituted or unsubstituted alkyl group having 1 to 8 carbon atoms, and $R^4$ is a substituted or unsubstituted alkyl group having 1 to 8 carbon atoms, or a substituted or unsubstituted aryl group having 6 to 10 carbon atoms.

In more preferred combinations of the substituents, $B^1$ is a substituted or unsubstituted phenyl group or a substituted or unsubstituted 1,3,4-thiadiazolyl group, $R^3$ is a substituted or unsubstituted alkyl group having 1 to 6 carbon atoms, and $R^4$ is a substituted or unsubstituted alkyl group having 1 to 6 carbon atoms or a substituted or unsubstituted phenyl group.

In the most preferred combinations of the substituents, $B^1$ is a 4-nitrophenyl group or a 1,3,4-thiadiazolyl group substituted with a thioalkyl group having 1 to 6 carbon atoms, $R^3$ is an unsubstituted alkyl group having 1 to 4 carbon atoms, and $R^4$ is an unsubstituted alkyl group having 1 to 4 carbon atoms or a substituted or unsubstituted phenyl group. The substituent of the phenyl group of $R^4$ is preferably a 2-chloro group, a 4-chloro group, a 2,4,6-trichloro group, a 4-carboxylmethyl group or a 4-carboxyethyl group.

Hereinafter, specific examples of the dye represented by formula (Y2) will be shown, but the present invention is not limited thereto.

Y2-1

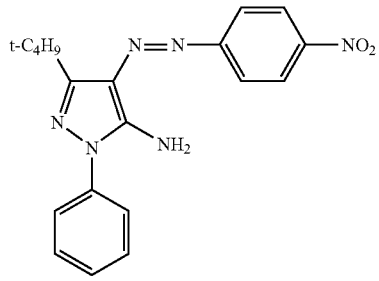

Y2-2

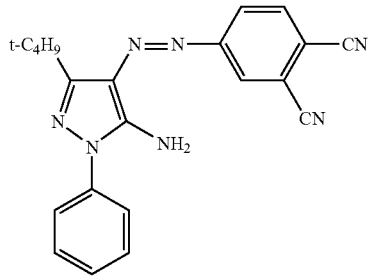

Y2-3

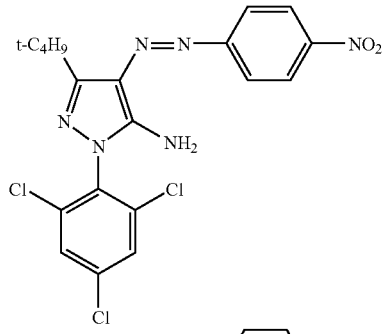

Y2-4

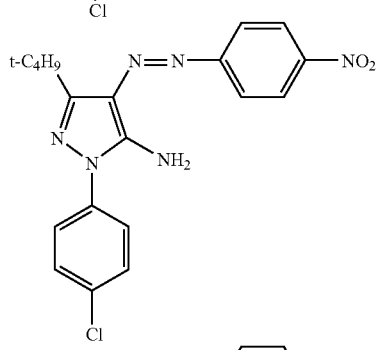

Y2-5

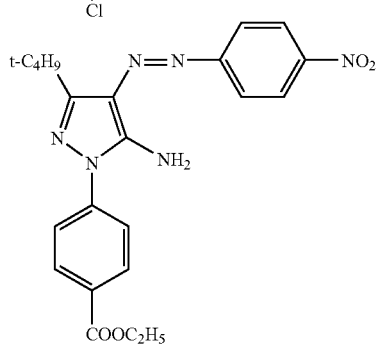

-continued

Y2-6

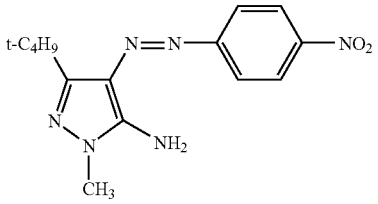

Y2-7

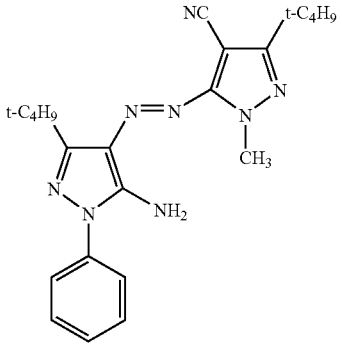

Y2-8

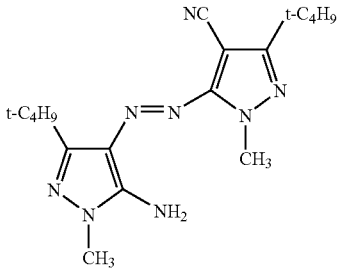

Y2-9

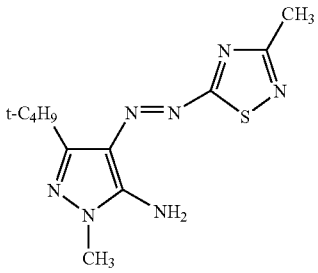

Y2-10

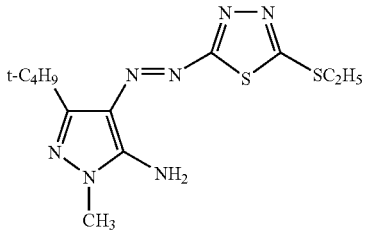

These dyes can be synthesized with ease by the method described in JP-A-1-225592 or by a method similar to the method.

In the thermal transfer layer of the ink sheet that is used in the present invention, known dyes that have been used from the past may be used as a magenta dye. Of theses dyes, it is preferred to use at least one dye represented by formula (M1) or (M2) set forth below. However, the aforementioned magenta dyes that are used in the present invention are not limited to these dyes.

Formula (M1)

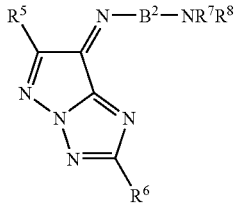

In the formula (M1), $B^2$ represents a substituted or unsubstituted phenylene group or a substituted or unsubstituted divalent pyridine ring group, and $R^5$, $R^6$, $R^7$ and $R^8$, which are mutually independent, each represent a substituted or unsubstituted alkyl group, a substituted or unsubstituted alkenyl group or a substituted or unsubstituted aryl group.

$R^5$, $R^6$, $R^7$ and $R^8$ each may further have a substituent. Examples of a substituent by which each of the groups of $B^2$, $R^5$, $R^6$, $R^7$ and $R^8$ may be substituted include the same substituents as each of the ring A and the substituents $R^1$ and $R^2$ in the formula (Y1) may have.

The phenylene group of $B^2$ is preferably a 1,4-phenylene group which may have a substituent. $B^2$ is more preferably a phenylene group which may have a substituent than a divalent pyridine ring group.

Examples of a preferred combination of the divalent group $B^2$ and the substituents $R^5$ to $R^8$ in a dye represented by the formula (M1) include combinations wherein $B^2$ is an unsubstituted phenylene group, $R^5$ is a substituted or unsubstituted alkyl group having 1 to 8 carbon atoms or a substituted or unsubstituted aryl group having 6 to 10 carbon atoms, $R^6$ is a substituted or unsubstituted alkyl group having 1 to 8 carbon atoms or a substituted or unsubstituted aryl group having 6 to 10 carbon atoms, $R^7$ is a substituted or unsubstituted alkyl group having 1 to 8 carbon atoms or an allyl group, and $R^8$ is a substituted or unsubstituted alkyl group having 1 to 8 carbon atoms or an allyl group.

In more preferred combinations of the divalent group $B^2$ and the substituents $R^5$ to $R^8$, $B^2$ is an unsubstituted phenylene group, $R^5$ is a substituted or unsubstituted phenyl group, $R^6$ is a substituted or unsubstituted alkyl group having 1 to 8 carbon atoms, $R^7$ is a substituted or unsubstituted alkyl group having 1 to 6 carbon atoms, and $R^8$ is a substituted or unsubstituted alkyl group having 1 to 6 carbon atoms.

In the most preferred combinations, the divalent group $B^2$ is an unsubstituted phenylene group, $R^5$ is a 2-chlorophenyl group, $R^6$ is a substituted or unsubstituted alkyl group having 1 to 4 carbon atoms, $R^7$ is a substituted or unsubstituted alkyl group having 1 to 4 carbon atoms, and $R^8$ is a substituted or unsubstituted alkyl group having 1 to 4 carbon atoms. When the alkyl group of $R^8$ further has a substituent, the substituent is preferably a cyano group.

M1-1

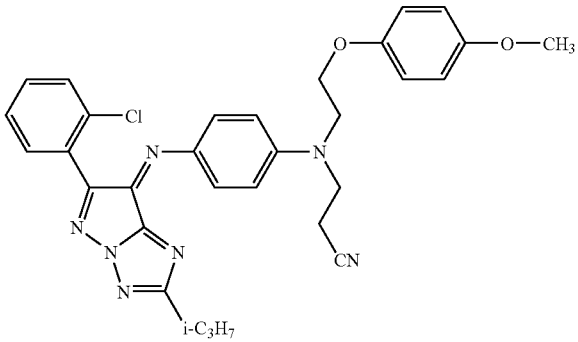

M1-2

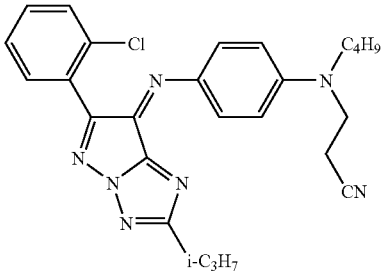

M1-3

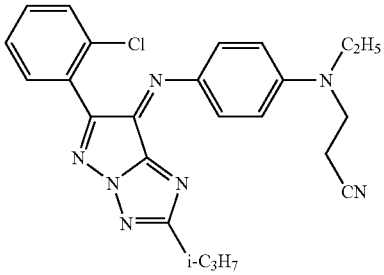

M1-4

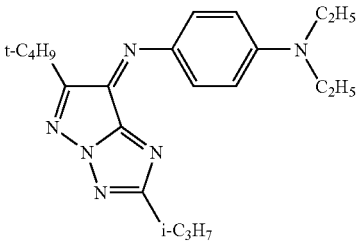

M1-5

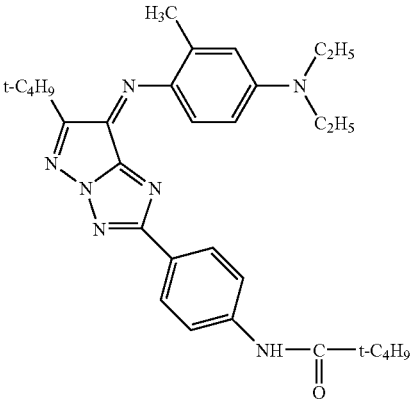

-continued

M1-6

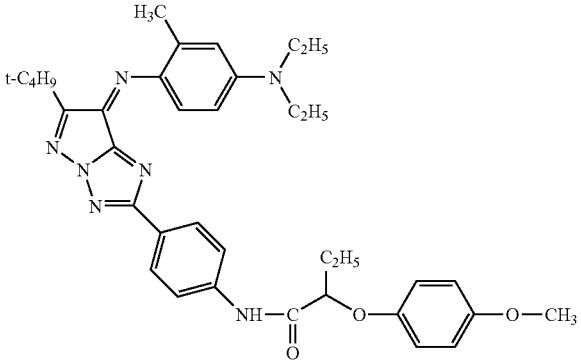

M1-7

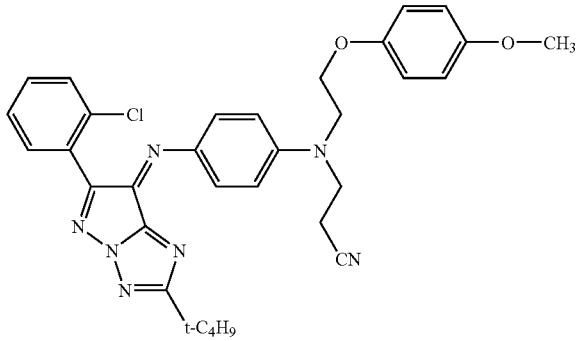

The compound represented by formula (M2) is explained in detail.

Formula (M2)

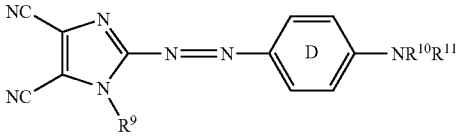

In the formula (M2), the ring D represents a substituted or unsubstituted benzene ring, and $R^9$, $R^{10}$ and $R^{11}$, which are mutually independent, each represent a substituted or unsubstituted alkyl group, a substituted or unsubstituted alkenyl group or a substituted or unsubstituted aryl group. $R^9$ further represents a hydrogen atom.

Each of the groups represented by $R^9$, $R^{10}$ and $R^{11}$ may further have a substituent. Examples of a substituent by which the ring D, $R^9$, $R^{10}$ and $R^{11}$ each may be substituted include the same substituents as each of the ring A, $R^1$ and $R^2$ in the formula (Y1) may have.

Examples of a preferred combination of the ring D and the substituents $R^9$ to $R^{11}$ in a dye represented by the formula (M2) include combinations wherein the ring D is a benzene ring substituted by an acylamino group having 2 to 8 carbon atoms, $R^9$ is a substituted or unsubstituted alkyl group having 1 to 8 carbon atoms or an acyl group, $R^{10}$ is a substituted or unsubstituted alkyl group having 1 to 8 carbon atoms or an allyl group, and $R^{11}$ is a substituted or unsubstituted alkyl group having 1 to 8 carbon atoms or an allyl group.

In more preferred combinations of the ring D and the substituents $R^9$ to $R^{11}$, the ring D is a benzene ring substituted by an acylamino group having 2 to 6 carbon atoms, $R^9$ is a substituted or unsubstituted alkyl group having 1 to 6 carbon atoms or an acyl group, $R^{10}$ is a substituted or unsubstituted alkyl group having 1 to 6 carbon atoms or an allyl group, and $R^{11}$ is a substituted or unsubstituted alkyl group having 1 to 6 carbon atoms or an allyl group.

In the most preferred combinations, the ring D is a benzene ring substituted by an acylamino group having 2 to 4 carbon atoms, $R^9$ is a substituted or unsubstituted alkyl group having 1 to 4 carbon atoms or an acyl group, $R^{10}$ is a substituted or unsubstituted alkyl group having 1 to 4 carbon atoms or an allyl group, and $R^{11}$ is a substituted or unsubstituted alkyl group having 1 to 4 carbon atoms or an allyl group.

M2-1

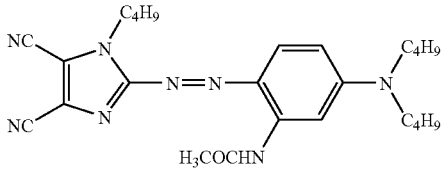

M2-2

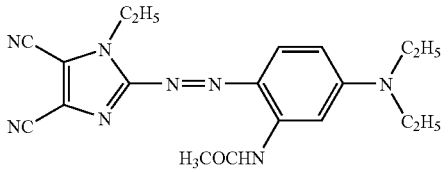

M2-3

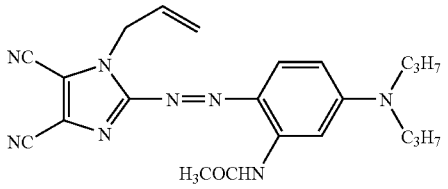

M2-4

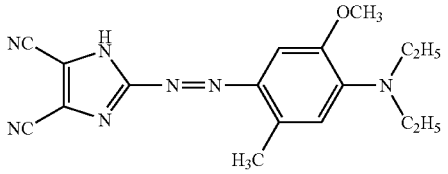

M2-5

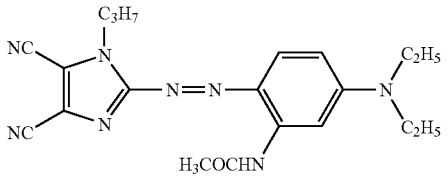

M2-6

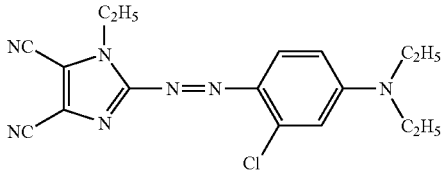

M2-7

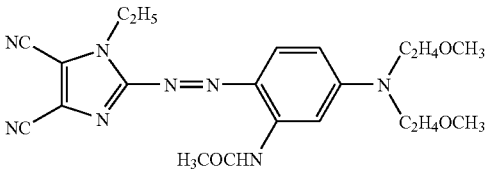

In the heat-sensitive transfer layer of the ink sheet that is used in the present invention, use can be made of known dyes that have been used as a cyan dye from the past. Of theses dyes, it is preferred to use dyes represented by formula (C1) or (C2) set forth below. However, the cyan dyes that can be used in the present invention are not limited thereto.

The dye represented by formula (C1) is explained in detail.

Formula (C1)

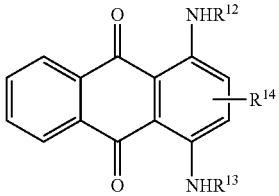

In the formula (C1), $R^{12}$ and $R^{13}$, which are mutually independent, each represent a substituted or unsubstituted alkyl group or a substituted or unsubstituted aryl group. $R^{14}$ represents a hydrogen atom or a substituent.

Each group of $R^{12}$ and $R^{13}$ may further have a substituent. Examples of a substituent by which each group of $R^{12}$ and $R^{13}$ may further be substituted include the same substituents as the ring A and each group of $R^1$ and $R^2$ in the formula (Y1) may have. Examples of the substituent of $R^{14}$ include the same substituents as the ring A and each group of $R^1$ and $R^2$ in the formula (Y1) may have.

Examples of a substituent suitable as $R^{14}$ include a halogen atom, an alkyl group, an alkenyl group, an alkynyl group, an aryl group, a heterocyclic group, a cyano group, an alkoxyl group, an aryloxy group, an acyloxy group, a carbamoyloxy group, an alkoxycarbonyloxy group, an aryloxycarbonyloxy group, an amino group, an acylamino group, an aminocarbonylamino group, an alkoxycarbonylamino group, an aryloxycarbonylamino group, a sulfamoylamino group, an alkyl- or arylsulfonylamino group, an alkylthio group, a sulfamoyl group, an alkyl- or arylsulfinyl group, an alkyl- or arylsulfonyl group, an acyl group, an aryloxycarbonyl group, an alkoxycarbonyl group and a carbamoyl group (which each may further have a substituent). The preferred of these substituents are a hydrogen atom, a halogen atom, an alkyl group, an alkenyl group, an aryl group, a heterocyclic group, an alkoxy group, an aryloxy group, an acyloxy group, a carbamoyloxy group, an alkoxycarbonyloxy group, an aryloxycarbonyloxy group, an amino group, an acylamino group, an aminocarbonylamino group, an alkoxycarbonylamino group, an aryloxycarbonylamino group, an alkylthio group, an acyl group, an aryloxycarbonyl group, an alkoxycarbonyl group and a carbamoyl group. More preferred are a halogen atom, a substituted or unsubstituted alkyl group having 1 to 4 carbon atoms, a substituted or unsubstituted alkenyl group having 2 to 8 carbon atoms, a substituted or unsubstituted aryl group having 6 to 10 carbon atoms, a substituted or unsubstituted heterocyclic group, an alkoxycarbonyl group, and an aryloxycarbonyl group. Of these substituents, a substituted or unsubstituted alkyl group having 1 to 4 carbon atoms and an alkoxycarbonyl group whose alkoxy moiety contains 1 to 4 carbon atoms are preferred over the others.

Examples of a preferred combination of the substituents $R^{12}$ and $R^{13}$ in the formula (C1) include combinations wherein $R^{12}$ is a substituted or unsubstituted alkyl group having 1 to 8 carbon atoms or a substituted or unsubstituted aryl group having 6 to 10 carbon atoms, and $R^{13}$ is a substituted or unsubstituted alkyl group having 1 to 8 carbon atoms or a substituted or unsubstituted aryl group having 6 to 10 carbon atoms.

In more preferred combinations, $R^{12}$ is a substituted or unsubstituted alkyl group having 1 to 6 carbon atoms or a substituted or unsubstituted phenyl group, and $R^{13}$ is a substituted or unsubstituted alkyl group having 1 to 6 carbon atoms or a substituted or unsubstituted phenyl group.

In the most preferred combinations, $R^{12}$ is a substituted or unsubstituted alkyl group having 1 to 4 carbon atoms and $R^{13}$ is a substituted or unsubstituted alkyl group having 1 to 4 carbon atoms or a substituted or unsubstituted phenyl group.

C1-1

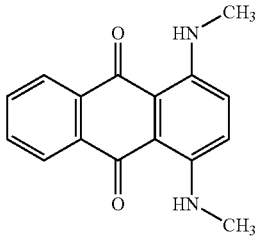

C1-2

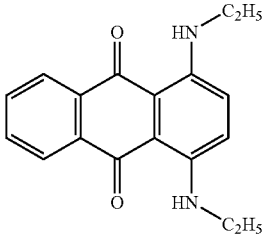

C1-3

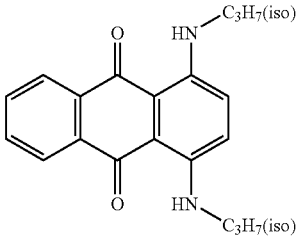

C1-4

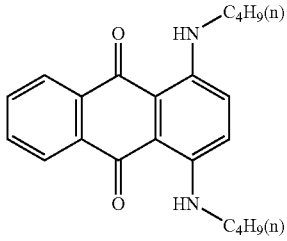

C1-5

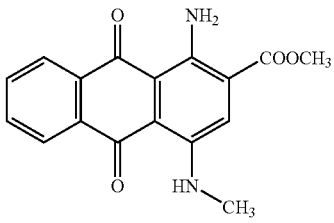

-continued

C1-6

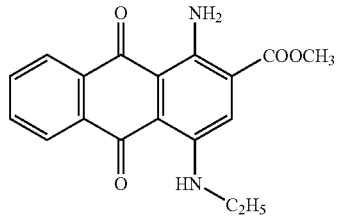

C1-7

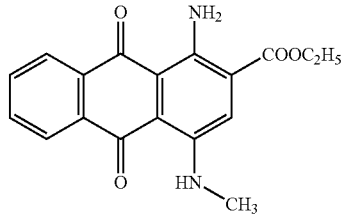

C1-8

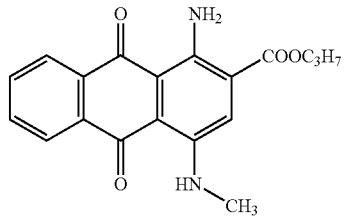

C1-9

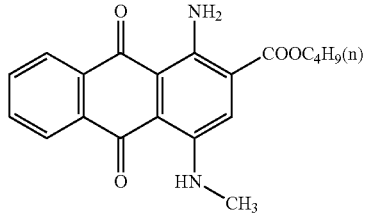

C1-10

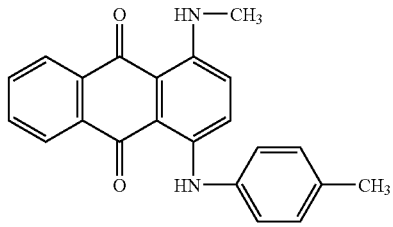

C1-11

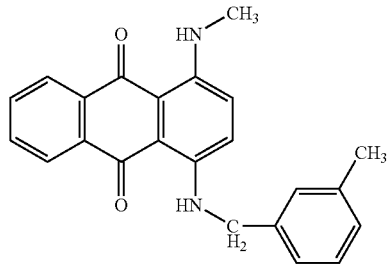

-continued

C1-12

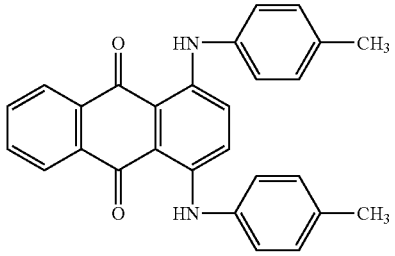

Among the dyes represented by the above-described formula (C1), those not available on the market can be synthesized according to the methods described in publications or specifications of U.S. Pat. Nos. 4,757,046 and 3,770,370, German Patent No. 2316755, JP-A-2004-51873, JP-A-7-137455, and JP-A-61-31292, and J. Chem. Soc. Perkin. Transfer I, 2047 (1977), Merocyanine Dye-Donor Element Used in thermal Dye Transfer, authored by Champan.

Next, the dye represented by formula (C2) is explained in detail.

Formula (C2)

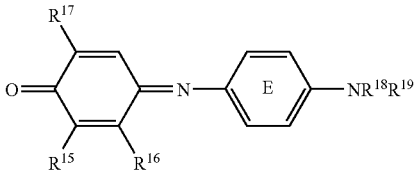

In the formula (C2), the ring E represents a substituted or unsubstituted benzene ring, $R^{15}$ represents a hydrogen atom or a halogen atom, $R^{16}$ represents a substituted or unsubstituted alkyl group, $R^{17}$ represents a substituted or unsubstituted acylamino group or a substituted or unsubstituted alkoxycarbonylamino group, and $R^{18}$ and $R^{19}$, which are mutually independent, each represent a substituted or unsubstituted alkyl group, a substituted or unsubstituted alkenyl group or a substituted or unsubstituted aryl group.

The ring E and each of the groups represented by $R^{16}$, $R^{17}$, $R^{18}$ and $R^{19}$ may further have substituents. Examples of substituents by which the ring E and each of the groups represented by $R^{16}$, $R^{17}$, $R^{18}$ and $R^{19}$ may be substituted are the same substituents as each of the ring A and the substituents $R^1$ and $R^2$ in the formula (Y1) may have.

Examples of a preferred combination of the ring E and the substituents $R^{15}$ to $R^{19}$ include combinations wherein the ring E is a benzene ring substituted by an alkyl group having 1 to 4 carbon atoms, a benzene ring substituted by a chlorine atom or an unsubstituted benzene ring, $R^{15}$ is a hydrogen atom, a chlorine atom or a bromine atom, $R^{16}$ is a substituted or unsubstituted alkyl group having 1 to 8 carbon atoms, $R^{17}$ is a substituted or unsubstituted acylamino group having 2 to 10 carbon atoms or a substituted or unsubstituted alkoxycarbonylamino group having 2 to 10 carbon atoms, $R^{18}$ is a substituted or unsubstituted alkyl group having 1 to 8 carbon atoms, and $R^{19}$ is a substituted or unsubstituted alkyl group having 1 to 8 carbon atoms.

In more preferred combinations of the ring E and the substituents $R^{15}$ to $R^{19}$, the ring E is a benzene ring substituted by an alkyl group having 1 to 2 carbon atoms or an unsubstituted benzene ring, $R^{15}$ is a hydrogen atom or a chlorine atom, $R^{16}$ is a substituted or unsubstituted alkyl group having 1 to 6 carbon atoms, $R^{17}$ is a substituted or unsubstituted acylamino group having 2 to 8 carbon atoms or a substituted or unsubstituted alkoxycarbonylamino group having 2 to 8 carbon atoms, $R^{18}$ is a substituted or unsubstituted alkyl group having 1 to 6 carbon atoms, and $R^{19}$ is a substituted or unsubstituted alkyl group having 1 to 6 carbon atoms.

In the most preferred combinations, the ring E is a benzene ring substituted by a methyl group or an unsubstituted benzene ring, $R^{15}$ is a hydrogen atom or a chlorine atom, $R^{16}$ is a substituted or unsubstituted alkyl group having 1 to 6 carbon atoms, $R^{17}$ is a substituted or unsubstituted acylamino group having 2 to 6 carbon atoms or a substituted or unsubstituted alkoxycarbonylamino group having 2 to 6 carbon atoms, $R^{18}$ is a substituted or unsubstituted alkyl group having 1 to 4 carbon atoms, and $R^{19}$ is a substituted or unsubstituted alkyl group having 1 to 4 carbon atoms.

C2-1

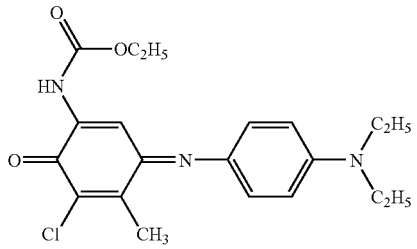

C2-2

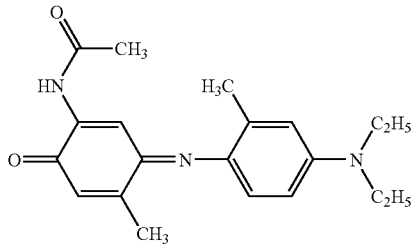

C2-3

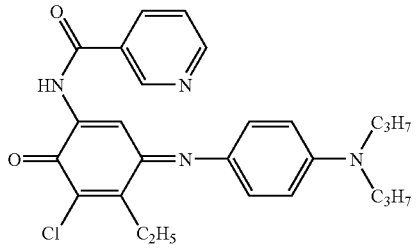

C2-4

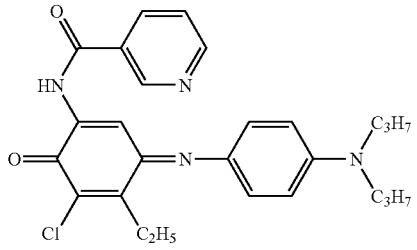

-continued

C2-5

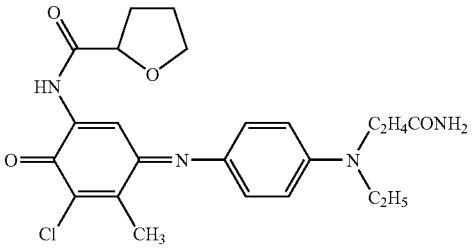

C2-6

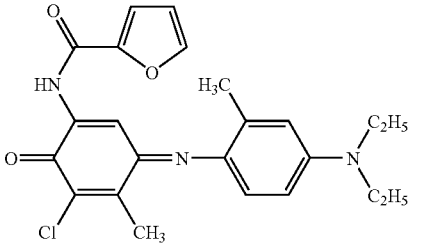

C2-7

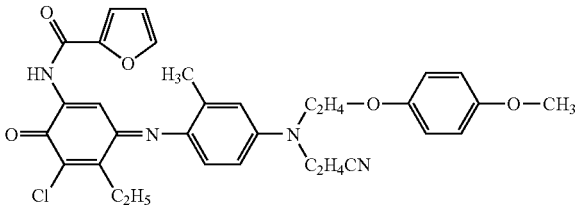

As the binder resins that are contained in a dye ink in order to carry the above-described dyes, various materials are known and are able to be used in the present invention. Examples of the resins include modified cellulose resins such as ethyl cellulose, hydroxyethyl cellulose, ethyl hydroxycellulose, hydroxypropyl cellulose, ethylhydroxyethyl cellulose, methyl cellulose, cellulose acetate, cellulose acetate butyrate, cellulose acetate propionate, and cellulose nitrate; vinyl resins such as polyvinyl alcohol, polyvinyl acetate, polyvinyl butyral, polyvinyl acetal, polyvinyl pyrroridone, polystyrene, and polyvinyl chloride; acrylic resins such as polyacrylonitrile, polyacrylic acid ester, and polyacrylamide; polyurethane resins; polyamide resins; polyester resins; polycarbonate resins; phenoxy resins; phenol resins; epoxy resins; and various kinds of elastomers. Each of these resins set forth above are preferably used. These resins may be used alone, or mixed together. In the case of polymers, various kinds of resin-constituting monomers may be copolymerized before use. It is also a preferable embodiment to bridge the polymers with various kinds of cross-linking agents.

Especially, modified cellulose resins and vinyl resins are preferably used. More preferably used are propionic acid-modified cellulose resins, polyvinyl butyral and polyvinyl acetal.

The dye ink can be prepared by dissolving or dispersing the above-described sublimation type dye and binder resin in a solvent. As the solvent that is used at the time of preparation, various kinds of known solvents can be used. Examples of the solvent include alcohol solvents such as methanol, ethanol, isopropyl alcohol, butanol, and isobutanol; ketone solvents such as methyl ethyl ketone, methyl isobutyl ketone, and cyclohexanone; aromatic solvents such as toluene and xylene; and water. The solvents may be used singly, or as a mixture thereof.

Next, explained is a composition of the heat-sensitive transfer sheet that is used in the present invention.

The heat-sensitive sheet of the present invention has at least one dye layer for at least one color, which is disposed on one surface of the support, and the dye layer is formed by applying a dye layer ink.

(Support)

As the support, any one of previously known materials can be used, so far as such the material has both a heat resistance and a mechanical strength necessary to the requirements for the support. Specific examples of preferable supports include thin papers such as a glassine paper, a condenser paper, and a paraffin paper; high-temperature resistant polyesters such as polyethyleneterephthalate, polyethylenenaphthalate, polybutyleneterephthalate, polyphenylene sulfide, polyetherketone, and polyethersulfone; stretched or unstretched films of plastics such as polypropylene, polycarbonate, cellulose acetate, polyethylene derivatives, polyvinyl chloride, polyvinylidene chloride, polystyrene, polyamide, polyimide, polymethylpentene, and ionomers; and laminates of these materials. Of these materials, polyester films are especially preferred. Stretched polyester films are most preferred. A thickness of the support can be properly determined in accordance with the material of the support so that the mechanical strength and the heat resistance become optimum. Specifically, it is preferred to use a support having a thickness of about 1 μm to about 100 μm, more preferably from about 2 μm to about 50 μm, and further preferably from about 3 μm to about 10 μm.

It is essential in the sublimation type heat-sensitive transfer recording system that only dye(s) having each hue that is contained in a heat-sensitive transfer sheet must be transferred at the time of printing. Transfer of a resin carrying the dye is not preferred. Therefore, a strong adhesion between a dye layer and a support of the heat-sensitive transfer sheet is required. If the adhesion is weak, the dye layer in itself adheres to a heat-sensitive image-receiving sheet, thereby resulting in deterioration of image quality of printing.

However, in the case of the support such as a polyester film exemplified above as a preferable support, wettability of the ink with each hue as described later is not so sufficient that adhesive strength occasionally lacks.

In order to deal with such the problem, it is preferred to employ a method of physically treating a surface of the support, and/or a method of forming an easy adhesion layer.

It is preferred to form an easy adhesion layer composed of a resin on a support and to dispose a dye layer on the easy adhesion layer. As a resin for forming the easy adhesion layer, there can be used, for example, urethane resins, polyester resins, polypropylene resins, polyol resins, acrylic resins, and reaction products of these resins and isocyanate compounds. Examples of the isocyanate compounds include diisocyanate compounds and triisocyanate compounds, each of which is conventionally used. A coating amount of the resin preferably ranges from 0.05 $g/m^2$ to 0.1 $g/m^2$.

In the production of the heat-sensitive transfer sheet, a support on which an easy adhesion layer is disposed in advance can be used, and a dye layer can be formed on the said support.

(Dye Layer)

The dye layer in the present invention is formed by applying a coating liquid (a dye layer ink) for the dye layer on a support using a gravure printing method or other forming means, followed by drying. The ink for dye layer is obtained by dissolving or dispersing a sublimation type dye, a binder resin and, a releasing agent optionally additives such as organic or inorganic finely divided powder in a proper solvent.

A thickness of the heat transfer layer is preferably in the range of from about 0.2 g/m$^2$ to about 5 g/m$^2$, more preferably from about 0.4 g/m$^2$ to about 2 g/m$^2$ at the dry state. A content of the sublimation type dye in the heat transfer layer is preferably in the range of from 5% by mass to 90% by mass, more preferably from about 10% by mass to about 70% by mass.

(Transferable Protective Layer Laminate)

It is a preferable embodiment in the present invention to dispose a transferable protective layer laminate in the heat-sensitive transfer sheet. The transferable protective layer laminate is used to protect a heat-sensitive transferred image by forming a protective layer composed of a transparent resin on the heat-sensitive transferred image by heat-sensitive transfer, thereby to improve durability such as scratch resistance, light-fastness, and resistance to weather. Under the conditions that a dye transferred to the image-receiving sheet is left to be exposed at the surface of the image-receiving sheet, image durability, such as light-fastness, scratch resistance, and chemical resistance, are unsatisfactory. Therefore, it is preferred to dispose the transparent protective layer. As exemplified in FIG. 2, a releasing layer 4*a*, a protective layer 4*b* and an adhesive layer 4*c* can be formed in the support in this order from the support side. The protective layer may be formed by plural layers. In the case where the protective layer also has functions of other layers, the releasing layer 4*b* and the adhesive layer 4*c* can be omitted. It is also possible to use a support on which an easy adhesive layer has already been formed.

As a resin forming the protective layer, preferred are resins that are excellent in scratch resistance, chemical resistance, transparency and hardness. Examples of the resin include polyester resins, polystyrene resins, acrylic resins, polyurethane resins, acrylic urethane resins, silicone-modified resins of the above-described resins, mixtures of these resins, ionizing radiation-curable resins, and ultraviolet-shielding resins. In addition, there can be used various kinds of resins that are conventionally known as a resin for forming protective layer. Further, in order to give ultraviolet absorbing capacity, or to improve coat separation properties at the time of transfer, gloss, brightness, or the like, it is also preferred to add ultraviolet absorbing agents, antioxidants, fluorescent brightening agents, organic fillers and/or inorganic fillers in accordance with necessity.

As the acrylic resin used in the present invention, it is preferable that polymers derived from at least one monomer selected from conventionally known acrylate monomers and methacrylate monomers. Other monomers than these acrylate-series monomers, such as styrene and acrylonitrile may be co-polymerized with said acrylic-series monomers. A preferred monomer is methyl methacrylate. It is preferred that methyl methacrylate is contained in terms of preparation mass ratio of 50 mass % or more in the polymer.

As the polyester resin used in the present invention, there can be used conventionally known saturated polyester resins. Examples of an acid component of the polyester resin used in the present invention, include aromatic dicarboxylic acids such as terephthalic acid, isophthalic acid, orthophthalic acid, 2,6-naphthalene dicarboxylic acid, tetrahydrophthalic acid, hexahydrophthalic acid, hexahydroisophthalic acid, and hexahydroterephthalic acid; aliphatic dicarboxylic acids such as succinic acid, adipic acid, azelaic acid, sebacic acid, dodecanedionic acid, and dimmer acid; and alicyclic dicarboxylic acids such as cyclohexane dicarboxylic acid, tricyclodecane dicarboxylic acid, and decalin dicarboxylic acid. Methyl-esterified derivatives of these compounds may be also used. Further, acid anhydrides of these compounds may be also used.

Further, if necessary, the above-mentioned compounds may be also used together with other compounds such as p-(hydroxyethoxy)benzoic acid, hydroxypivalic acid, γ-butyryllactone, ϵ-caprolactone, fumaric acid, maleic acid, maleic acid anhydride, itaconic acid, and citraconic acid. Further, if necessary, the above-mentioned compounds may be also used together with tri- or more multi-functional polycarboxylic acids such as tri and tetra carboxylic acids (e.g., trimellitic acid, pyromellitic acid), in so far as the proportion of the tri- or more multi-functional polycarboxylic acids is 10 mol % or less of the entire carboxylic acid components. Particularly preferred is the composition that contains at least one acid component which is an aromatic carboxylic acid a part of which is substituted with a sulfonic acid or a salt thereof, in one molecular chain. It is preferable to conduct copolymerization with setting the upper limit of a substitution amount of the sulfonic acid (or salt thereof) within a range that ensures solubility to organic solvents, since this would make it possible to use the polyester resin with mixing with other organic-solvent-soluble additives or resins. As a preferable aromatic dicarboxylic acid substituted with the sulfonic acid (or salt thereof), there are exemplified sulfoterephthalic acid, 5-sulfoisophthalic acid, 4-sulfophthalic acid, 4-sulfonaphthalene-2,7-dicarboxylic acid, 5-(4-sulfophenoxy)isophthalic acid, ammonium salts of these acids, and metal salts of these acids wherein examples of the metal include lithium, potassium, magnesium, calcium, copper, and iron. Of these acids, sodium salt of 5-sulfoisophthalic acid is especially preferred.

Examples of a polyol component that is another component of the polyester resin that can be used in the present invention, include ethylene glycol, 1,2-propylene glycol, 1,3-propane diol, 1,4-butane diol, neopentyl glycol, 1,5-pentane diol, 1,6-hexane diol, 3-methyl-1,5-pentane diol, 1,9-nonane diol, 2-ethyl-2-butylpropane diol, hydroxypivalic acid neopentylglycol ester, dimethylolheptane, and 2,2,4-trimethyl-1,3'-pentane diol. If necessary, there can be also used diethylene glycol, triethylene glycol, dipropylene glycol, polyethylene glycol, polypropylene glycol, polytetramethylene glycol, ethylene oxide adducts of neopentyl glycol, and propylene oxide adducts of neopentyl glycol.

As aromatic-group-containing glycols, there are paraxylene glycol, metaxylene glycol, orthoxylene glycol, 1,4-phenylene glycol, ethylene oxide adduct of 1,4-phenylene glycol, bisphenol A, and glycols obtained by adding from 1 to several moles of ethylene oxide or propylene oxide to the two phenolic hydroxyl groups of bisphenols, such as ethylene oxide adducts or propylene oxide adducts of bisphenol A. Examples of alicyclic diol components include tricyclodecane diol, tricyclodecane dimethylol, tricyclodecane dimethanol (TCD-M), cyclohexane diol, 1,4-cyclohexane dimethanol, hydrogenated bisphenol A, ethylene oxide adducts or propylene oxide adducts of hydrogenated bisphenol A. As the above-described polyester resin, a preferable glass transition temperature ranges from 50° C. to 120° C., and a preferable molecular weight ranges from 2,000 to 40,000. A molecular weight ranging from 4,000 to 20,000 is more preferred, because so-called "foil-off" properties at the time of transfer of the protective layer are improved.

The use of the ionizing radiation-curable resins enables to obtain a protective layer that is excellent in both resistance to plasticizers and scratch resistance in particular. As an example, there are resins that are obtained by cross-linking and curing radical polymerizable polymers or oligomers upon irradiation of ionizing radiation. In this case, polymerization and cross-link may be performed by adding a photopolymerization initiator in accordance with necessity, followed by irradiation of electron beam or ultraviolet ray. Further, known ionizing radiation-curable resins can be used.

It is also a preferable embodiment that a protective layer contains ultraviolet-absorbing agents and/or ultraviolet-shielding resins in order to give light-fastness to the printed matter.

As the ultraviolet absorbing agents, use can be made of conventionally known inorganic or organic ultraviolet absorbing agents. As the organic ultraviolet absorbing agents, use can be made of non-reactive ultraviolet absorbing agents such as salicylate-series, benzophenone-series, benzotriazole-series, triazine-series, substituted acrylonitrile-series, nickel chelate-series, and hindered amine-series ultraviolet absorbing agents. As the ultraviolet-shielding resins, use can be made of copolymers or graft polymers of thermoplastic resins (e.g., acrylic resins) obtained by introducing addition-polymerizable double bonds originated from a vinyl group, an acryroyl group, a methacryroyl group, or the like to the above-described non-reactive ultraviolet absorbing agents, or alternatively by introducing thereto other types of groups such as an alcoholic hydroxyl group, an amino group, a carboxyl group, an epoxy group, and an isocyanate group. Of these ultraviolet absorbing agents, especially preferred are benzophenone-series, benzotriazole-series, and triazine-series ultraviolet absorbing agents.

In addition, disclosed is a method of obtaining ultraviolet-shielding resin by the steps of dissolving ultraviolet absorbing agents in a monomer or oligomer of the resin that is used in the protective layer, and then polymerizing the monomer or oligomer (JP-A-2006-21333). In this case, the ultraviolet absorbing agents may be not reactive.

Examples of the articles that have been sold as ultraviolet absorbing agents on the market include Tinuvin-P (a product of Ciba-Geigy), JF-77 (a product of JOHOKU CHEMICAL), SEA SOUP 701 (a product of SHIROISHI CALCIUM), SUMI SOUP 200 (a product of Sumitomo Chemical), BIO SOUP 520 (a product of KYODO CHEMICAL), and ADK STAB LA-32 (a product of ADEKA).

With respect to these ultraviolet-absorbing agents, it is preferred to use a combination of ultraviolet-absorbing agents having a different system from each other so that an effective ultraviolet-absorbing wavelength region can be covered in accordance with characteristics of the dye that is used for image formation. With respect to the non-reactive ultraviolet-absorbing agents, a mixture of ultraviolet-absorbing agents having a different structure from each other is preferably used in order to prevent the ultraviolet-absorbing agent from precipitation.

Examples of the organic fillers and/or the inorganic fillers include polyethylene wax, bis-amide, nylon, acrylic resin, cross-linked polystyrene, silicone resin, silicone rubber, talc, calcium carbonate, titanium oxide, alumina, and silica fine particles such as micro silica and colloidal silica. In the heat-sensitive transfer sheet according to the present invention, not only these exemplified materials, but also known other materials can be used preferably.

With respect to the organic fillers and/or the inorganic fillers, it is preferred that not only a particle size of the fillers is 10 μm or less, preferably in the range of from 0.1 μm to 3 μm but also the fillers have good sliding properties and high transparency. An addition amount of the filler is preferably a degree to which transparency is kept at the time of transfer. Specifically, the addition amount is preferably in the range of from 0 to 100 mass parts, based on 100 mass parts of the resin.

Depending on the kind of resin for forming protective layer, the protective layer is formed by the same method as the method of forming the above-described dye layer. A thickness of the protective layer is preferably in the range of from about 0.5 μm to about 10 μm.

(Release Layer)

In the case where a protective layer is difficult to separate from a support at the time of transfer, it is also a preferable embodiment to form a release layer 4*a* between the support and the protective layer. The release layer can be formed by the steps of preparing a coating liquid composed of a material that is excellent in release properties, such as waxes, silicone wax, silicone resin, and fluorine resin; a relatively high melting point resin that does not melt by heat from a thermal head, such as cellulose-based resin, acrylic resin, polyurethane resin, polyvinyl acetal resin, acrylic vinyl ether-based resin, maleic acid anhydride resin, silicone resin, fluorine resin; or the above-described resins containing a heat release agent such as waxes, and then coating the coating liquid according to a previously known coating method such as gravure coat and gravure reverse coat, followed by drying. Of these resins, preferred are acrylic resins obtained by polymerizing acrylic acid or methacrylic acid singly, or copolymerizing acrylic acid or methacrylic acid with other monomers. These acrylic resins are excellent in adhesion to the substrate sheet, and release properties from the protective layer. Further, these resins may be used alone or in a combination of these resins.

The release layer remains at the side of a support at the time of printing (transfer).

A thickness of the release layer is preferably in the range of from about 0.5 μm to about 5 μm. Various kinds of particles are incorporated in the release layer, or alternatively a surface of the release layer at the protective layer-coating side is subjected to a mat treatment, thereby to mat the surface of the release layer. Resultantly, the surface of the image-receiving sheet after printing can be mat-finished (flatten).

A separation layer may be formed between a transferable protective layer and a release layer. The separation layer is transferred together with the protective layer. After transfer, the separation layer becomes the outermost layer of the printed image-receiving sheet. Therefore, the separation layer is composed of a resin that is excellent in transparency, abrasion resistance and chemical resistance. As the resin, there are exemplified acrylic resin, epoxy resin, polyester resin, and styrene resin. Further, additives such as fillers and waxes may be added to the separation layer.

(Adhesive Layer)

It is preferred to dispose an adhesive layer on a protective layer as the outermost layer of the transferable protective layer laminate. Thereby, transfer properties of the protective layer are improved. In the adhesive layer, there can be used known pressure-sensitive adhesives, heat-sensitive adhesives, and thermoplastic resins. Specific examples of the adhesives include resins that are excellent in adhesiveness at the time of heating, such as polyester resin, vinyl chloride-vinyl acetate copolymer resin, acrylic resin, acrylic material-ultraviolet absorbing agent copolymer resin, ultraviolet absorbing resin, butyral resin, epoxy resin, polyamide resin, vinyl chloride resin, and polycarbonate resin. Of these resins, preferred are thermoplastic resins having a glass transition temperature of from 40° C. to 80° C.

If Tg is less than 40° C., adhesiveness between the coated image and a transparent protective layer tends to become insufficient. On the other hand, if Tg is more than 80° C., transfer properties of the transparent protective layer tends to become insufficient.

Further, especially preferred are polyvinylchloride resins, polyvinyl acetate resins, and vinyl chloride-vinyl acetate copolymer resins, each of which has a polymerization degree of from 50 to 300, more preferably from 50 to 250.

As the ultraviolet absorbing resin, there can be used resins such as products that are obtained by reaction and bonding of a thermoplastic resin or an ionizing radiation curable resin with a reactive ultraviolet absorbing agent. More specifically, use can be made of resins that are obtained by reaction and bonding between a non-reactive ultraviolet absorber and a thermoplastic resin or an ionizing radiation curable resin. In the said reactive ultraviolet absorber, a reactive group such as an addition-polymerizable double bonding (e.g., vinyl, acryloyl, methacryloyl groups), an alcoholic hydroxyl group, an amino group, a carboxyl group, an epoxy group, or an isocyanato group has been introduced into a previously known non-reactive organic ultraviolet absorber such as salicylate series, phenyl acrylate series, benzophenone series, benzotriazole series, coumarine series, triazine series, nickel chelate series, substituted acrylonitrile series, and hindered amine series ultraviolet absorbers.

To the adhesion layer, the followings may be added: the above-described resins and additives including organic ultraviolet absorbing agents such as benzophenone-series compounds, benzotriazole-series compounds, oxalic anilide-series compounds, cyanoacrylate-series compounds, and salicylate-series compounds, and inorganic fine particles having ultraviolet absorbing capacity (for example, oxides of metal such as zinc, titanium, cerium, tin, and iron). Further, it is optional to add other additives such as coloring pigments, white pigments, extender pigments, fillers, antistatic agents, antioxidants, and fluorescent whitening agents in accordance with necessity. The adhesion layer is formed by coating and then drying a coating liquid containing the above-described resin for construction of the adhesion layer, and the above-described additives that are optionally added to the adhesion layer, so that a thickness of the adhesion layer preferably becomes a range of from 0.5 μm to about 10 μm at the dry state. A dry thickness of the adhesive layer preferably ranges from 0.5 μm to 5 μm, more preferably from 0.5 μm to 3 μm.

(Back Layer)

The back surface of the heat-sensitive transfer sheet directly contacts with a heating device such as a thermal head, and the sheet travels while the back surface is heated. Therefore, it is preferred to dispose a back layer on the back surface of a support in order to smooth the traveling by preventing the back surface from being heat sealed with the heating device such as a thermal head.

In the back layer, there can be used alone or a mixture of natural or synthetic resins such as cellulosic-series resins (for example, ethyl cellulose, hydroxy cellulose, hydroxypropyl cellulose, methyl cellulose, cellulose acetate, cellulose acetate butyrate, and nitro cellulose), vinyl-series resins (for example, polyvinyl alcohol, polyvinyl acetate, polyvinyl butyral, polyvinyl acetal, and polyvinyl pyrrolidone), acrylic-series resins (for example, polymethyl methacrylate, polyethyl methacrylate, polyacryl amide, and acrylonitrile-styrene copolymer), polyamide resins, polyvinyl toluene resins, cumarone indene resins, polyester-series resins, polyurethane resins, silicone-modified or fluorine-modified polyurethane resins, and silicone resins.

In order to improve heat resistance of the back layer, it is a preferable embodiment that the back layer is modified with a crosslinking agent into a crosslinked resin layer.

Further to improve traveling, it is preferable to contain a solid or liquid releasing agent or lubricant in a back layer. As the solid or liquid releasing agent or lubricant, known compounds can be used. Examples of these compounds include various kinds of waxes such as zinc stearate, stearic acid amide, carnauba wax, montan wax, polyethylene wax, and paraffin wax, higher aliphatic acid alcohol, organopolysiloxanes, anionic surfactants, cationic surfactants, amphoteric surfactants, nonionic surfactants, fluorine-containing surfactants, organic carboxylic acids and derivatives thereof, organic carboxylic acid and their derivatives, fluorine resins, silicone resin, phosphoric acid ester compounds, and organic or inorganic fine particles.

Such the back layer can be formed using a known coating method. A thickness of the back layer is preferably in the range of from 0.1 μm to 10 μm, more preferably from 0.3 μm to 5 μm, and especially preferably from 0.5 μm to 3 μm.

The heat-sensitive transfer sheets of the present invention and the producing method thereof are explained.

Taking as an example the case where each of yellow, magenta and cyan dye layers has been formed in a frame-sequential order on the same support, the heat-sensitive transfer sheet has a long and narrow support sheet, each of yellow, magenta and cyan dye regions (heat-sensitive transfer layers) disposed at different positions from each other in the longer direction of the support, and a detecting mark disposed at the ends of the dye regions on the support. The detecting mark is disposed perpendicular to the longer direction.

For formation of these layers, there can be used known coating methods. Examples of the coating methods include roll coat, bar coat, gravure coat, and gravure reverse coat.

Taking as an example the printing method using a printing cylinder, firstly a yellow dye region is printed using a yellow printing cylinder, secondly a magenta dye region is printed using a magenta printing cylinder, and thirdly a cyan dye region is printed using a cyan printing cylinder. At the last, detecting marks are simultaneously printed using a mark printing cylinder.

It is possible to print using printing plate portions of plural dye layers disposed on the same printing cylinder (multiple plating). However, in this method, there is sometimes the case where the manufactured transfer layers are delicately different in thickness or the like from each other owing to a manufacturing error or the like of each printing plate portion. If a printing (dye transfer to the image-receiving sheet) is performed using the thus-prepared heat-sensitive transfer sheet, a difference in color hue is easy to occur. For preventing this trouble, it is possible to print different detecting marks for each at least one region of each of the dye layer regions, or for every each pair of the dye layer regions.

In the above, there was explained the case where the heat-sensitive transfer sheet has each of the yellow, magenta and cyan dye layer regions. However, the present invention is not limited to such the composition, but a black layer and/or a transferable protective layer laminate may be disposed in addition to the above-described three color dye layers.

Next, the heat-sensitive transfer image-receiving sheet (image receiving sheet) used in the present invention will be explained.

The heat-sensitive (thermal) transfer image-receiving sheet used in the present invention is provided with at least one dye-receiving layer (receptor layer) on a support, and at least one heat insulation layer (porous layer) between the support and the receptor layer. Moreover, an undercoat layer such as a white-background-control layer, a charge-control layer (an electrification-control layer), an adhesive layer, and a primer layer, may be provided between the receptor layer and the heat insulation layer.

The receptor layer and the heat insulation layer are preferably formed by a simultaneous multi-layer coating. When the undercoat layer is provided, the receptor layer, the undercoat layer, and the heat insulation layer may be formed by the simultaneous multi-layer coating.

It is preferable that a curling control layer, a writing layer, or a charge-control layer be formed on the backside of the support. Each of these layers may be applied using a usual method such as a roll coating, a bar coating, a gravure coating, and a gravure reverse coating.

<Receptor Layer>

[Thermoplastic Resin]

In the present invention, a thermoplastic resin is preferably used in the receptor layer. Examples of the thermoplastic resin (polymer) that is preferably used in the receptor layer in the present invention include vinyl-series resins, such as halogenated polymers (e.g., polyvinyl chloride and polyvinylidene chloride), polyvinyl acetate, ethylene-vinyl acetate copolymer, vinyl chloride-vinyl acetate copolymer, polyacryl ester, polystyrene, and polystyrene acrylate; acetal-series resins, such as polyvinylformal, polyvinylbutyral and polyvinylacetal; polyester-series resins, such as polyethylene terephthalate, polybutylene terephthalate; polycarbonate-series resins; cellulose-series resins, such as those described in JP-A-4-296595 or JP-A-2002-264543 or cellulose acetate butyrate (e.g., CAB551-0.2 and CAB321-0.1 (trade names) manufactured by Eastman Chemical Company); polyolefin-series resins, such as polypropylene; and polyamide-series resins, such as urea resins, melamine resins and benzoguanamine resins. These resins may be used optionally blending with each other in the range of compatibility. Resins used for forming the receptor layer are also disclosed in JP-A-57-169370, JP-A-57-207250 and JP-A-60-25793.

It is further preferable that, among these polymers, the receptor layer preferably contain a polycarbonate, a polyester, a polyurethane, a polyvinyl chloride or its copolymer, a styrene-acrylonitrile copolymer, a polycaprolactone, or a mixture of two or more of these. It is particularly preferable that the receptor layer contain a polycarbonate, a polyester, a polyvinyl chloride or its copolymer, or a mixture of two or more of these. The following is a more detailed explanation of polyester, and polyvinyl chloride. Incidentally, these polymers may be used singly or as mixtures thereof.

(Polyester-Series Polymers)

The polyester-series polymers used in the receptor layer in the present invention is explained in more detail.

The polyester polymers are obtained by polycondensation of a dicarboxylic acid component (including a derivative thereof) and a diol component (including a derivative thereof). The polyester polymers preferably contain an aromatic ring and/or an aliphatic ring. As to technologies related to the alicyclic polyester, those described in JP-A-5-238167 are useful from the viewpoints of ability to incorporate a dye and image stability.

In the present invention, as the polyester polymers, it is preferable to use polyester polymers obtained by polycondensation using at least one of the above-described dicarboxylic acid components and at least one of the above-described diol components, so that the thus-obtained polyester polymers could have a molecular weight (mass average molecular weight (Mw)) of generally about 11,000 or more, preferably about 15,000 or more, and more preferably about 17,000 or more. If polyester polymers of too low molecular weight are used, elastic coefficient of the formed receptor layer becomes low and also it raises lack of thermal resistance. Resultantly, it sometimes becomes difficult to assure the releasing property of the heat-sensitive transfer sheet and the image-receiving sheet. A higher molecular weight is more preferable from a viewpoint of increase in elastic coefficient. The molecular weight is not limited in particular, so long as such failure does not occur that a higher molecular weight makes the polymer difficult to be dissolved in a solvent for a coating solution at the time of forming the receptor layer, or that an adverse effect arises in adhesive properties of the receptor layer to a substrate sheet after coating and drying the receptor layer. However, the molecular weight is preferably about 25,000 or less, and at highest a degree of about 30,000. The polyester polymers may be synthesized according to a known method.

Examples of a saturated polyester used as the polyester polymers include VYLON 200, VYLON 290 and VYLON 600 (each trade name, manufactured by Toyobo Co., Ltd.), KA-1038C (trade name, manufactured by Arakawa Chemical Industries, Ltd.), and TP220 and TP235 (each trade name, manufactured by The Nippon Synthetic Chemical Industry Co., Ltd.).

(Vinyl Chloride-Series Polymers)

The vinyl chloride-series polymers, particularly a copolymer using vinyl chloride, used in the receptor layer are explained in more detail.

The polyvinyl chloride-series copolymer is preferably one having a vinyl chloride constituent content of 85 to 97% by mass and a polymerization degree of 200 to 800. A monomer forming such a copolymer together with vinyl chloride has no particular restrictions, and any monomer may be used as far as it can be copolymerized with vinyl chloride. However, it is particularly preferably vinyl acetate. Accordingly, the polyvinyl chloride copolymer used in the receptor layer is advantageously a vinyl chloride-vinyl acetate copolymer. However, the vinyl chloride-vinyl acetate copolymer is not necessarily constituted of vinyl chloride and vinyl acetate alone, and may include vinyl alcohol and maleic acid constituents to an extent to which the effects of the present invention would be obtained. Examples of other monomer constituents of such a copolymer constituted mainly of vinyl chloride and vinyl acetate include vinyl alcohol and its derivatives such as vinyl propionate; acrylic or methacrylic acids and their derivatives such as their methyl, ethyl, propyl, butyl and 2-ethylhexyl esters; maleic acid and its derivatives such as diethyl maleate, dibutyl maleate and dioctyl maleate; vinyl ether derivatives such as methyl vinyl ether, butyl vinyl ether and 2-ethylhexyl vinyl ether; acrylonitrile and methacrylonitrile; and styrene. The ratio of each of the vinyl chloride and vinyl acetate components in the copolymer may be any ratio, but it is preferable that the ratio of the vinyl chloride component is 50 mass % or more of the copolymer. In addition, it is preferable that the ratio of the above-recited constituents other than the vinyl chloride and vinyl acetate is 10 mass % or less of the copolymer.

Examples of such a vinyl chloride-vinyl acetate copolymer include SOLBIN C, SOLBIN CL, SOLBIN CH, SOLBIN CN, SOLBIN C5, SOLBIN M, SOLBIN MF, SOLBIN A, SOLBIN AL (trade names, manufactured by Nissin Chemical Industry Co., Ltd.); S-LEC A, S-LEC C and S-LEC M (trade names, manufactured by Sekisui Chemical Co., Ltd.); DENKA VINYL 100GKT, DENKA VINYL 100L, DENKA VINYL 1000CK, DENKA VINYL 1000A, DENKA VINYL 1000LK2, DENKA VINYL 1000AS, DENKA VINYL 1000GS, DENKA VINYL 1000LT3, DENKA VINYL 1000D and DENKA VINYL 1000W (trade names, manufactured by Denki Kagaku Kogyo Kabushiki Kaisha).

The above-recited polymers are dissolved in a proper solvent such as methyl ethyl ketone, ethyl acetate, benzene, toluene and xylene, so that the resultant solution can be coated on a support.

(Latex Polymer)

In the present invention, other than the aforementioned polymers, latex polymers can also be preferably used. Hereinafter, the latex polymer will be explained.

In the heat-sensitive transfer image-receiving sheet used in the present invention, the latex polymer that can be used in the receptor layer is preferred to form a dispersion in which hydrophobic polymers comprising a monomer unit of water-insoluble vinyl chloride are dispersed as fine particles in a water-soluble dispersion medium. The dispersed state may be one in which polymer is emulsified in a dispersion medium, one in which polymer underwent emulsion polymerization, one in which polymer underwent micelle dispersion, one in which polymer molecules partially have a hydrophilic structure and thus the molecular chains themselves are dispersed in a molecular state, or the like. Latex polymers are described in "Gosei Jushi Emulsion (Synthetic Resin Emulsion)", compiled by Taira Okuda and Hiroshi Inagaki, issued by Kobunshi Kanko Kai (1978); "Gosei Latex no Oyo (Application of Synthetic Latex)", compiled by Takaaki Sugimura, Yasuo Kataoka, Souichi Suzuki, and Keishi Kasahara, issued by Kobunshi Kanko Kai (1993); Soichi Muroi, "Gosei Latex no Kagaku (Chemistry of Synthetic Latex)", issued by Kobunshi Kanko Kai (1970); Yoshiaki Miyosawa (supervisor) "Suisei Coating-Zairyo no Kaihatsu to Oyo (Development and Application of Aqueous Coating Material)", issued by CMC Publishing Co., Ltd. (2004) and JP-A-64-538, and so forth. The dispersed particles preferably have a mean particle size (diameter) of about 1 to 50,000 nm, more preferably about 5 to 1,000 nm.

The particle size distribution of the dispersed particles is not particularly limited, and the particles may have either wide particle-size distribution or monodispersed particle-size distribution.

The latex polymer for use in the present invention may be latex of the so-called core/shell type, other than ordinary latex polymer of a uniform structure. When using a core/shell type latex polymer, it is preferred in some cases that the core and the shell have different glass transition temperatures. The glass transition temperature (Tg) of the latex polymer for use in the present invention is preferably −30° C. to 100° C., more preferably 0° C. to 80° C., further more preferably 10° C. to 70° C., and especially preferably 15° C. to 60° C.

The latex polymer that can be used in the receptor layer, use can be made of polyvinyl chlorides, a copolymer comprising vinyl chloride unit, such as a vinyl chloride-vinyl acetate copolymer and a vinyl chloride acrylate copolymer. In this case, the vinyl chloride unit in molar ratio is preferably in the range of from 50% to 95%. These polymers may be straight-chain, branched, or cross-linked polymers, the so-called homopolymers obtained by polymerizing single type of monomers, or copolymers obtained by polymerizing two or more types of monomers. In the case of the copolymers, these copolymers may be either random copolymers or block copolymers. The molecular weight of each of these polymers is preferably 5,000 to 1,000,000, and further preferably 10,000 to 500,000 in terms of number average molecular weight. Polymers having excessively small molecular weight impart insufficient dynamic strength to the layer containing the latex, and polymers having excessively large molecular weight bring about poor filming ability. Crosslinkable latex polymers are also preferably used.

The latex polymer that can be used in the present invention is commercially available, and polymers described below may be utilized. Examples thereof include G351 and G576 (trade names, manufactured by Nippon Zeon Co., Ltd.); VINYBLAN 240, VINYBLAN 270, VINYBLAN 277, VINYBLAN 375, VINYBLAN 386, VINYBLAN 609, VINYBLAN 550, VINYBLAN 601, VINYBLAN 602, VINYBLAN 630, VINYBLAN 660, VINYBLAN 671, VINYBLAN 683, VINYBLAN 680, VINYBLAN 680S, VINYBLAN 681N, VINYBLAN 685R, VINYBLAN 277, VINYBLAN 380, VINYBLAN 381, VINYBLAN 410, VINYBLAN 430, VINYBLAN 432, VINYBLAN 860, VINYBLAN 863, VINYBLAN 865, VINYBLAN 867, VINYBLAN 900, VINYBLAN 900GT, VINYBLAN 938 and VINYBLAN 950 (trade names, manufactured by Nissin Chemical Industry Co., Ltd.).

These latex polymers may be used singly, or two or more of these polymers may be blended, if necessary.

In the receptor layer, a ratio of the latex polymer comprising a component of vinyl chloride is preferably 50 mass % or more of the whole solid content in the layer.

In the present invention, it is preferable to prepare the receptor layer by applying an aqueous type coating solution and then drying it. The so-called "aqueous type" here means that 60% by mass or more of the solvent (dispersion medium) of the coating solution is water. As a component other than water in the coating solution, a water miscible organic solvent may be used, such as methyl alcohol, ethyl alcohol, isopropyl alcohol, dimethylformamide, ethyl acetate, diacetone alcohol, furfuryl alcohol, benzyl alcohol, diethylene glycol monoethyl ether, and oxyethyl phenyl ether.

In combination with the above-described latex polymer for use in the present invention, any polymer can be used. The polymer that can be used in combination is preferably transparent or translucent, and colorless. The polymer may be a natural resin, polymer, or copolymer; a synthetic resin, polymer, or copolymer; or another film-forming medium; and specific examples include gelatins, polyvinyl alcohols, hydroxyethylcelluloses, cellulose acetates, cellulose acetate butyrates, polyvinylpyrrolidones, caseins, starches, polyacrylic acids, polymethylmethacrylic acids, polyvinyl chlorides, polymethacrylic acids, styrene-maleic anhydride copolymers, styrene-acrylonitrile copolymers, styrene-butadiene copolymers, polyvinyl acetals (e.g. polyvinyl formals, polyvinyl butyrals), polyesters, polyurethanes, phenoxy resins, polyvinylidene chlorides, polyepoxides, polycarbonates, polyvinyl acetates, polyolefins, and polyamides. In the coating liquid, a binder may be dissolved or dispersed in an aqueous solvent or in an organic solvent, or may be in the form of an emulsion.

The glass transition temperature (Tg) of the binder for use in the present invention is preferably in the range of −30° C. to 70° C., more preferably −10° C. to 85° C., still more preferably 0° C. to 70° C., in view of film-forming properties (brittleness for working) and image preservability. A blend of two or more types of polymers can be used as the binder. When a blend of two or more polymers is used, the average Tg obtained by summing up the Tg of each polymer weighted by its proportion, is preferably within the foregoing range. Further, when phase separation occurs or when a core-shell structure is adopted, the weighted average Tg is preferably within the foregoing range.

[Releasing Agent]

If the image-receiving surface of the heat-sensitive transfer image-receiving sheet lacks a sufficient releasing property, problems of so-called abnormal transfer arises. Examples of the abnormal transfer include a problem that a heat-sensitive transfer sheet and a heat-sensitive transfer image-receiving sheet mutually weld by heat from a thermal head for the image-forming, and thereby a big noise due to peeling arises at the time of peeling; a problem that a dye layer is entirely transferred; and a problem that the receptor layer is peeled from the support. As a method of solving such problems of releasing property, there are known a method of introducing various kinds of releasing agents (lubricant) in the receptor layer and a method of disposing a releasing layer additionally on the receptor layer. In the present invention, it is preferable to use a releasing agent in the receptor layer in order to keep more securely the releasing property between the heat-sensitive transfer sheet and the image-receiving sheet at the time of printing images.

As the releasing agent, solid waxes such as polyethylene wax, amide wax and Teflon (registered trade name) powder; silicone oil, phosphate-series compounds, fluorine-based surfactants, silicone-based surfactants and others including releasing agents known in the technical fields concerned may be used. Among these, fluorine-series compounds typified by fluorine-based surfactants, silicone-based surfactants and silicone-series compounds such as silicone oil and/or its hardened products are preferably used.

In some cases, a dye binder is transferred to the receptor layer in a highlight portion of monochrome printing, to cause an irregular transfer. In addition, it is known that an addition polymerization-type silicone generally progresses a hardening reaction in the presence of a catalyst, and that almost all of complexes of transition metal of VIII group, such as Fe group and Pt group, are effective as the hardening catalyst. Among these, a platinum compound has the highest efficiency in general, and a platinum catalyst, which is generally a platinum complex soluble in the silicone oil, is preferably used. Addition amount necessary for the reaction is generally sufficiently about 1 to 100 ppm.

In the present invention, the amount of the receptor layer to be applied is preferably 0.5 to 10 g/m$^2$ (solid basis, hereinafter, the amount to be applied in the present specification is a value on solid basis unless otherwise noted).

<Releasing Layer>

In the case where the hardened modified silicone oil is not added to the receptor layer, the silicone oil may be added to a releasing layer provided on the receptor layer. In this case, the receptor layer may be provided using at least one of the above-described thermoplastic resins. Besides, a receptor layer to which silicone is added may be used. The releasing layer contains a hardened modified silicone oil. A kind of the silicone to be used and a method of using the silicone are the same as for use in the receptor layer. Also, in the case where a catalyst or a retardant is used, the above described descriptions related to addition of these additives to the receptor layer may be applied. The releasing layer may be formed using only a silicone, or alternatively a mixture of a silicone and a binder resin having a good compatibility therewith. A thickness of the releasing layer is generally in the range of about 0.001 to about 1 g/m$^2$.

Examples of the fluorine surfactants include Fluorad FC-430 and FC-431 (trade names manufactured by 3M Corp.).

(Heat Insulation Layer)

A heat insulation layer serves to protect the support from heat when a thermal head or the like is used to carry out a transfer operation under heating. Further, because the heat insulation layer generally has proper cushion characteristics, a heat-sensitive transfer image-receiving sheet having high printing sensitivity can be obtained even in the case of using paper as a support. The heat insulation layer may be a single layer, or multi-layers. The heat insulation layer is generally arranged at a nearer location to the support than the receptor layer.

In the image-receiving sheet for use in the present invention, the heat insulation layer contains hollow polymer particles.

The hollow polymer particles in the present invention are polymer particles having independent pores inside of the particles. Examples of the hollow polymer particles include (1) non-foaming type hollow particles obtained in the following manner: a dispersion medium, such as water, is contained inside of a capsule wall formed of a polystyrene, acrylic resin, or styrene/acrylic resin, and, after a coating solution is applied and dried, the dispersion medium in the particles is vaporized out of the particles, with the result that the inside of each particle forms a hollow; (2) foaming type microballoons obtained in the following manner: a low-boiling point liquid, such as butane and pentane, is encapsulated in a resin constituted of any one of polyvinylidene chloride, polyacrylonitrile, polyacrylic acid, and polyacrylate, or their mixture or polymer, and after the resin coating material is applied, it is heated to expand the low-boiling point liquid inside of the particles, whereby the inside of each particle is made to be hollow; and (3) microballoons obtained by foaming the above (2) under heating in advance, to make hollow polymer particles.

The particle size of the hollow polymer particles is preferably 0.1 to 20 μm, more preferably 0.1 to 2 μm, further preferably 0.1 to 1 μm, particularly preferably 0.2 to 0.8 μm. It is because an excessively small size may lead to decrease of the void ratio (hollow ratio) of the particles, prohibiting desirable heat-insulating property, while an excessively large size in relation to the film thickness of the heat insulation layer may result in problems in preparation of smooth surface and cause coating troubles due to the coarse or bulky particles.

These hollow polymer particles preferably have a hollow ratio of about 20 to 70%, more preferably 20 to 50%. With the hollow ratio of less than 20%, it cannot give a sufficient heat-insulating property, while with an excessively large hollow ratio for the hollow particles that have the above-described preferable particle diameter, it cannot give a sufficient film strength owing to increase of imperfect hollow particles.

The glass transition temperature (Tg) of the hollow polymer particles is preferably 70° C. or higher, more preferably 100° C. or higher. These hollow polymer particles may be used in combinations of two or more of those, according to the need.

Such hollow polymer particles are commercially available. Specific examples of the above (1) include Rohpake 1055, manufactured by Rohm and Haas Co.; Boncoat PP-1000, manufactured by Dainippon Ink and Chemicals, Incorporated; SX866(B), manufactured by JSR Corporation; and Nippol MH5055, manufactured by Nippon Zeon (all of these product names are trade names). Specific examples of the above (2) include F-30, and F-50, manufactured by Matsumoto Yushi-Seiyaku Co., Ltd. (all of these product names are trade names). Specific examples of the above (3) include F-30E, manufactured by Matsumoto Yushi-Seiyaku Co., Ltd, and Expancel 461DE, 551DE, and 551DE20, manufactured by Nippon Ferrite (all of these product names are trade names). Among these, the hollow polymer particles of the above (1) may be preferably used.

A water-dispersible resin or water-soluble type resin is preferably contained, as a binder, in the heat insulation layer containing the hollow polymer particles. As the binder resin that can be used in the present invention, known resins such as an acrylic resin, styrene/acrylic copolymer, polystyrene resin, polyvinyl alcohol resin, vinyl acetate resin, ethylene/vinyl acetate copolymer, vinyl chloride/vinyl acetate copolymer, styrene/butadiene copolymer, polyvinylidene chloride resin, cellulose derivative, casein, starch, and gelatin may be used. In the present invention, use of a gelatin is particularly preferable. Further, these resins may be used either singly or as mixtures.

The solid content of the hollow polymer particles in the heat insulation layer preferably falls in a range from 5 to 2,000 parts by mass, more preferably 5 to 1,000 parts by mass, and further preferably 5 to 400 parts by mass, assuming that the solid content of the binder resin be 100 parts by mass. Further, the ratio by mass of the solid content of the hollow polymer particles in the coating solution is preferably 1 to 70% by mass and more preferably 10 to 40% by mass. If the ratio of the hollow polymer particles is excessively low, sufficient heat insulation cannot be obtained, whereas if the ratio of the hollow polymer particles is excessively large, the adhesion between the hollow polymer particles is reduced, and thereby sufficient film strength cannot be obtained, causing deterioration in abrasion resistance.

A thickness of the heat insulation layer containing the hollow polymer particles is preferably from 5 to 50 μm, more preferably from 5 to 40 μm.

(Hydrophilic Polymer)

The heat insulation layer preferably contains a hydrophilic polymer (hereinafter also referred to as water-soluble polymer or a water-soluble high molecular compound). The water-soluble polymer which can be used in the present invention is natural polymers (polysaccharide type, microorganism type, and animal type), semi-synthetic polymers (cellulose-based, starch-based, and alginic acid-based), and synthetic polymer type (vinyl type and others); and synthetic polymers including polyvinyl alcohols, and natural or semi-synthetic polymers using celluloses derived from plant as starting materials, which will be explained later, correspond to the water-soluble polymer usable in the present invention.

Herein, "water-soluble polymer" means a polymer which dissolves, in 100 g water at 20° C., in an amount of preferably 0.05 g or more, more preferably 0.1 g or more, further preferably 0.5 g or more, and particularly preferably 1 g or more.

Among the water-soluble polymers which can be used in the present invention, the natural polymers and the semi-synthetic polymers will be explained in detail. Specific examples include the following polymers: plant type polysaccharides such as gum arabics, κ-carrageenans, ι-carrageenans, λ-carrageenans; microbial type polysaccharides such as xanthan gums (e.g. Keltrol T, manufactured by Kelco) and dextrins (e.g. Nadex 360, manufactured by National Starch & Chemical Co.); animal type natural polymers such as gelatins (e.g. Crodyne B419, manufactured by Croda) and caseins; cellulose-based polymers such as ethylcelluloses (e.g. Cellofas WLD, manufactured by I.C.I.), carboxymethylcelluloses (e.g. CMC, manufactured by Daicel), hydroxyethylcelluloses (e.g. HEC, manufactured by Daicel), hydroxypropylcelluloses (e.g. Klucel, manufactured by Aqualon), methylcelluloses (e.g. Viscontran, manufactured by Henkel), nitrocelluloses (e.g. Isopropyl Wet, manufactured by Hercules), and cationated celluloses (e.g. Crodacel QM, manufactured by Croda) (all of the names are trade names).

Gelatin is one of preferable embodiments in the present invention. Gelatin having a molecular weight of from 10,000 to 1,000,000 may be used in the present invention.

Among water-soluble polymers that can be used in the present invention, especially synthetic polymers are explained in detail.

Examples of such the synthetic polymers include acrylic polymers such as polyacrylic acid; vinyl polymers such as polyvinyl alcohol; and others such as polyethylene glycol, polypropylene glycol, polyisopropylacrylamide, polymethylvinyl ether, polyethyleneimine, polystyrene sulfonic acid or copolymers thereof, and water-soluble polyesters. Of these water-soluble synthetic polymers that can be used in the present invention, preferred are polyvinyl alcohols.

As the polyvinyl alcohols, there can be used various kinds of polyvinyl alcohols such as completely saponified products, partially saponified products, and a modified polyvinyl alcohols. With respect to these polyvinyl alcohols, those described in "Poval", authored by Koichi Nagano et al., published by Kobunshi Kankokai, Inc. are useful.

The viscosity of polyvinyl alcohol can be adjusted or stabilized by adding a trace amount of a solvent or an inorganic salt to an aqueous solution of polyvinyl alcohol, and there can be employed compounds described in the aforementioned reference "Poval", authored by Koichi Nagano et al., published by Kobunshi Kankokai, pp. 144-154. For example, a coated-surface quality can be improved by an addition of boric acid, and the addition of boric acid is preferable. The amount of boric acid added is preferably 0.01 to 40 mass % with respect to polyvinyl alcohol.

In the present invention, preferred water-soluble polymers are polyvinyl alcohols and gelatin, with gelatin being most preferred.

The amount of the water-soluble polymer added to the heat insulation layer is preferably from 1 to 75% by mass, more preferably from 1 to 50% by mass based on the entire mass of the heat insulation layer.

When a gelatin is used in the heat insulation layer, the amount of the gelatin in the coating solution for the heat insulation layer is preferably 0.5 to 14% by mass, and particularly preferably 1 to 6% by mass. Further, the coating amount of the above hollow polymer particles in the heat insulation layer is preferably 1 to 100 g/m$^2$, and more preferably 5 to 20 g/m$^2$.

Further, the water-soluble polymers that are contained in the heat insulation layer may be cross-linked with a hardener in order to regulate cushion properties and film strength. Preferable examples of the hardener that can be used in the present invention include H-1, 4, 6, 8, and 14 in JP-A-1-214845 on page 17; compounds (H-1 to H-54) represented by one of the formulae (VII) to (XII) in U.S. Pat. No. 4,618,573, columns 13 to 23; compounds (H-1 to H-76) represented by the formula (6) in JP-A-2-214852, page 8, the lower right (particularly, H-14); and compounds described in Claim 1 in U.S. Pat. No. 3,325,287. A preferred ratio of a cross-linked water-soluble polymer in the heat insulation layer varies depending on the kind of the crosslinking agent, but the water-soluble polymer in the heat insulation layer is crosslinked by preferably 0.1 to 20 mass %, more preferably 1 to 10 mass %, based on the entire water-soluble polymer.

In the present invention, it is also a preferable embodiment that a water-soluble polymer used in the heat insulation layer is also used in the above-described receptor layer. Preferable water-soluble polymers are the same as those of the heat insulation layer.

(Undercoat Layer)

An undercoat layer may be formed between the receptor layer and the heat insulation layer. As the undercoat layer, for example, at least one of a white background controlling layer, a charge controlling layer, an adhesive layer, and a primer layer is formed. These layers may be formed in the same manner as those described in, for example, each specification of Japanese Patent Nos. 3585599 and 2925244.

(Support)

There is no particular limitation to the support that can be used in the present invention. However, preferred are supports known in the field of heat-sensitive transfer image-receiving sheets. A water-proof support is particularly preferably used. The use of the waterproof support makes it possible to prevent the support from absorbing moisture, thereby a fluctuation in the performance of the receptor layer with lapse of time can be prevented. As the waterproof support, for example, coated paper or laminate paper may be used.

The method of producing the heat-sensitive transfer image-receiving sheet for use in the present invention is explained below.

The heat-sensitive transfer image-receiving sheet for use in the present invention can be preferably formed, by applying at least one receptor layer, at least one intermediate layer and at least one heat-insulation layer, on a support, through simultaneous multi-layer coating.

In the case where a single layer is coated on a support, there can be preferably used a coating method such as coat with a bar coater and slide coat. Further, in the case of production for the heat-sensitive transfer image-receiving sheet composed of multiple layers having different functions from each other, such as an air void layer, a heat insulation layer, an interlayer, and a receptor layer, there can be used a known coating method such as a slide coating method and a curtain coating method.

In the present invention, the productivity is greatly improved and, at the same time, image defects can be remarkably reduced, by using the above simultaneous multilayer coating for the production of an image-receiving sheet having a multilayer structure.

In the present invention, the coating amount of a coating solution per one layer constituting the multilayer is preferably in a range from 1 g/m$^2$ to 500 g/m$^2$. The number of layers in the multilayer structure may be arbitrarily selected from a number of 2 or more. The receptor layer is preferably disposed as a layer most apart from the support.

In the image-forming method (system) of the present invention, imaging is achieved by superposing a heat-sensitive transfer sheet on a heat-sensitive transfer image-receiving sheet so that a heat transfer layer of the heat-sensitive transfer sheet is in contact with a receptor layer of the heat-sensitive transfer image-receiving sheet and giving thermal energy in accordance with image signals given from a thermal head.

Specifically, image-forming can be achieved by the similar manner to that as described in, for example, JP-A-2005-88545. In the present invention, a printing time is preferably less than 15 seconds, and more preferably in the range of 5 to 12 seconds, from the viewpoint of shortening a time to provide a print to a customer.

The heat-sensitive transfer sheet of the present invention develops no ribbon wrinkle, allows solution to the problem of causing heat-fusion bonding and sticking to an image-receiving sheet for heat-sensitive transfer recording, and ensures high-speed formation of high-density images.

The present invention will be described in more detail based on the following examples, but the invention is not intended to be limited thereto. In the following examples, the terms "part(s)" and "%" are values by mass, unless otherwise specified.

EXAMPLES

Preparation of Heat-Sensitive Transfer Sheets (Preparation of Heat-Sensitive Transfer Sheet-Coating Liquid and Protective Layer-Coating Liquid)

For preparation of heat-sensitive transfer sheets, the following coating liquids were prepared.

| Preparation of yellow-heat-transfer-layer-coating liquid PY-1 | |
|---|---|
| Yellow dye compound (Y2-3) | 3.9 parts by mass |
| Yellow dye compound (Y1-7) | 3.9 parts by mass |
| Polyvinylacetoacetal resin (trade name: ESLEC KS-1, manufactured by Sekisui Chemical Co., Ltd.) | 6.0 parts by mass |
| Polyvinylbutyral resin (trade name: DENKA BUTYRAL #5000-A, manufactured by DENKI KAGAKU KOGYOU K.K.) | 2.2 parts by mass |
| Releasing agent (trade name X-22-3000T, manufactured by Shin-Etsu Chemical Co., Ltd.) | 0.10 part by mass |
| Matting agent (trade name: Flo-thene UF, manufactured by Sumitomo Seika Chemicals Co., Ltd.) | 0.15 part by mass |
| Methyl ethyl ketone/toluene (2/1, at mass ratio) | 84 parts by mass |

| Preparation of magenta-heat-transfer-layer-coating liquid PM-1 | |
|---|---|
| Magenta dye compound (M1-2) | 0.2 parts by mass |
| Magenta dye compound (M2-1) | 0.7 parts by mass |
| Magenta dye compound (M2-3) | 6.5 parts by mass |
| Cyan dye compound (C2-2) | 0.4 parts by mass |
| Polyvinylacetoacetal resin (trade name: ESLEC KS-1, manufactured by Sekisui Chemical Co., Ltd.) | 8.0 parts by mass |
| Polyvinylbutyral resin (trade name: DENKA BUTYRAL #5000-A, manufactured by DENKI KAGAKU KOGYOU K.K.) | 0.2 parts by mass |
| Releasing agent (trade name: X-22-3000T, manufactured by Shin-Etsu Chemical Co., Ltd.) | 0.10 part by mass |
| Matting agent (trade name: Flo-thene UF, manufactured by Sumitomo Seika Chemicals Co., Ltd.) | 0.15 part by mass |
| Methyl ethyl ketone/toluene (2/1, at mass ratio) | 84 parts by mass |

| Preparation of cyan-heat-transfer-layer-coating liquid PC-1 | |
|---|---|
| Cyan dye compound (C1-3) | 1.2 parts by mass |
| Cyan dye compound (C2-2) | 6.6 parts by mass |
| Polyvinylacetoacetal resin (trade name: ESLEC KS-1, manufactured by Sekisui Chemical Co., Ltd.) | 7.3 parts by mass |
| Polyvinylbutyral resin (trade name: DENKA BUTYRAL #5000-A, manufactured by DENKI KAGAKU KOGYOU K.K.) | 0.9 parts by mass |
| Releasing agent (trade name: X-22-3000T, manufactured by Shin-Etsu Chemical Co., Ltd.) | 0.10 part by mass |
| Matting agent (trade name: Flo-thene UF, manufactured by Sumitomo Seika Chemicals Co., Ltd.) | 0.15 part by mass |
| Methyl ethyl ketone/toluene (2/1, at mass ratio) | 84 parts by mass |

| Preparation of heat-transferable protective-layer's releasing layer-coating liquid PU1 | |
|---|---|
| Modified cellulose resin (trade name: L-30, manufactured by DAICEL CHEMICAL INDUSTRIES, LTD.) | 5 parts by mass |
| Methyl ethyl ketone | 95 parts by mass |

| Preparation of heat-transferable protective-layer's peeling layer-coating liquid PO1 | |
|---|---|
| Acrylic resin solution (Solid content: 40%) (trade name: UNO-1, manufactured by Gifu Ceramics Limited) | 90 parts by mass |
| Methanol/isopropanol (1/1, at mass ratio) | 10 parts by mass |

| Preparation of heat-transferable protective-layer's adhesion layer-coating liquid A1 | |
|---|---|
| Acrylic resin (trade name: DIANAL BR-77, manufactured by MITSUBISHI RAYON CO., LTD.) | 25 parts by mass |
| The following ultraviolet absorber UV-1 | 1 part by mass |
| The following ultraviolet absorber UV-2 | 2 parts by mass |
| The following ultraviolet absorber UV-3 | 1 part by mass |
| The following ultraviolet absorber UV-4 | 1 part by mass |
| PMMA fine particles (polymethyl methacrylate fine particles) | 0.4 part by mass |
| Methyl ethyl ketone/toluene (2/1, at mass ratio) | 70 parts by mass |

(UV-1)

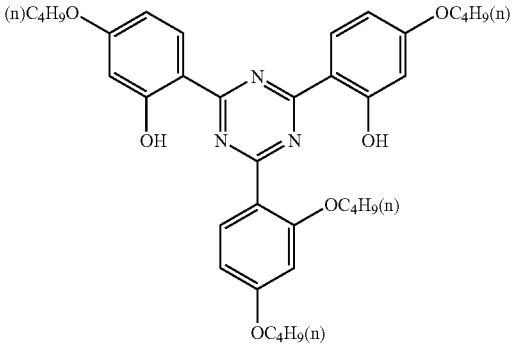

(UV-2)

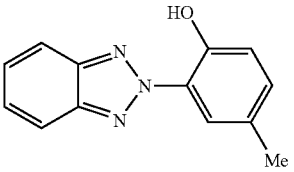

(UV-3)

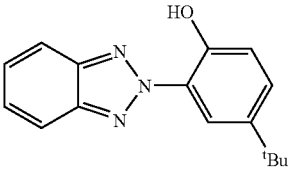

(UV-4)

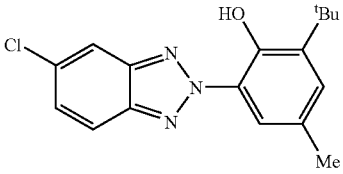

(Preparation of Back-Layer-Coating Liquid)

In order to produce a back heat resistant layer of the heat-sensitive transfer sheet, the following coating liquid was prepared.

| Preparation of back side layer-coating solution BC1 | |
|---|---|
| Acrylic-series polyol resin (trade name: ACRYDIC A-801, manufactured by Dainippon Ink and Chemicals, Incorporated) | 26.0 parts by mass |
| Zinc stearate (trade name: SZ-2000, manufactured by Sakai Chemical Industry Co., Ltd.) | 0.43 part by mass |
| Phosphate (trade name: PLYSURF A217, manufactured by Dai-ichi Kogyo Seiyaku Co., Ltd.) | 1.27 parts by mass |
| Isocyanate (50% solution) (trade name: BURNOCK D-800, manufactured by Dainippon Ink and Chemicals, Incorporated) | 8.0 parts by mass |
| Methyl ethyl ketone/toluene (2/1, at mass ratio) | 64 parts by mass |

(Preparation of Sheets by Coating of Coating Liquids Described Above)

A polyester film 6.0 μm in thickness (trade name: Diafoil K200E-6F, manufactured by MITSUBISHI POLYESTER FILM CORPORATION), that was subjected to an adhesion-treatment on one surface of the film, was used as a support. The above-mentioned back side-layer coating solution was applied onto the support on the other surface that was not subjected to the adhesion-treatment, so that the coating amount based on the solid content after drying would be 1 g/m$^2$. After drying, the coated film was hardened by heat at 60° C.

A heat-sensitive transfer sheet 100 was prepared by coating the above-described coating liquids on the easy adhesion layer coating side of the thus-prepared polyester film so that a yellow heat transfer layer, a magenta heat transfer layer, a cyan heat transfer layer, and a protective layer could be disposed sequentially in this order. In the case of forming a protective layer, after applying and drying of PU-1, namely a heat-transferable protective-layer's releasing layer-coating liquid on a substrate, PO-1, a heat-transferable protective-layer's peeling layer-coating liquid was applied thereon and dried. After that, A1, namely, a heat-transferable protective-layer's adhesion layer-coating liquid was applied and then dried.

A coating amount of each of five layers applied in this preparation was controlled so that the solid content coating amount would become the value set forth below.

| | |
|---|---|
| Yellow heat-transfer layer | 0.8 g/m$^2$ |
| Magenta heat-transfer layer | 0.8 g/m$^2$ |
| Cyan heat-transfer layer | 0.8 g/m$^2$ |
| Protective releasing layer | 0.3 g/m$^2$ |
| Protective peeling layer | 0.5 g/m$^2$ |
| Protective adhesive layer | 2.2 g/m$^2$ |

Samples 101 to 107 were further prepared by changing the kinds and/or amounts of the release agent in the thermal transfer layer coating liquid of each color as shown in Table 1. The alternative release agents therein were the following products.

TSF4701: A product of Momentive Performance Materials Japan

SG8427: Alcohol-modified silicone oil, a product of Dow Corning Toray Co., Ltd.

CRC-7025X: Silicone-modified polyimide resin, a product of SUMITOMO BAKELITE Co., Ltd.

[Preparation of Heat Sensitive Image-Receiving Sheet]

Preparation of Image-Receiving Sheet S1

A paper support, on both sides of which polyethylene was laminated, was subjected to corona discharge treatment on the surface thereof, and then a gelatin undercoat layer containing sodium dodecylbenzenesulfonate was disposed on the treated surface. On the gelatin layer, were multilayer-coated a subbing layer, a heat insulation layer, a lower layer of the receptor layer, an upper layer of the receptor layer having the following compositions in this order from the support side, according to the method described in FIG. 9 of U.S. Pat. No. 2,761,791. The coating was performed so that coating amounts of the subbing layer, the heat insulation layer, the lower layer of the receptor layer, the upper layer of the receptor layer after drying would be 6.7 g/m$^2$, 8.6 g/m$^2$, 2.6 g/m$^2$ and 2.7 g/m$^2$, respectively.

| Upper layer of the receptor layer | |
|---|---|
| Vinyl chloride-series latex (as a solid content) (trade name: Vinybran 900, manufactured by Nisshin Chemicals Co., Ltd.) | 22.2 parts by mass |
| Vinyl chloride-series latex (as a solid content) (trade name: Vinybran 276, manufactured by Nisshin Chemicals Co., Ltd.) | 2.5 parts by mass |
| Gelatin | 0.5 parts by mass |
| Ester-series wax EW-1 presented below | 2.0 parts by mass |
| Surfactant F-1 presented below | 0.04 part by mass |
| **Lower layer of the receptor layer** | |
| Vinyl chloride-series latex (as a solid content) (trade name: Vinybran 690, manufactured by Nisshin Chemicals Co., Ltd.) | 24.4 parts by mass |
| Gelatin | 1.4 parts by mass |
| Surfactant F-1 presented below | 0.04 parts by mass |
| **Heat insulation layer** | |
| Hollow latex polymer (as a solid content) (trade name: MH5055, manufactured by Nippon Zeon Co., Ltd.) | 579 parts by mass |
| Gelatin | 279 parts by mass |
| **Subbing layer** | |
| Polyvinyl alcohol (PovalPVA205, trade name, manufactured by KURARY CO., LTD.) | 16.8 parts by mass |
| Styrene-Butadiene rubber latex (as a solid content) (SN-102, trade name, manufactured by NIPPON A&L INC.) | 150 parts by mass |
| Surfactant F-1 presented below | 0.1 part by mass |

(EW-1)

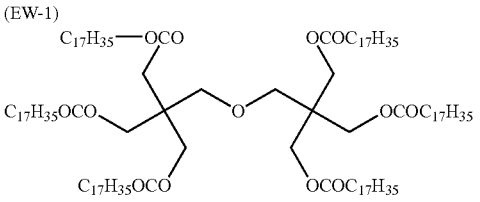

-continued (F-1)

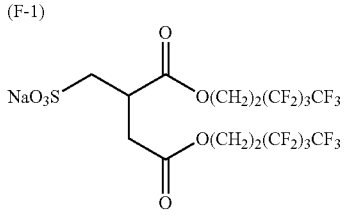

[Image Formation]

Each of the above heat-sensitive transfer sheets and the heat-sensitive transfer image-receiving sheet S1 were processed so that they can be loaded to a sublimation-type thermal transfer printer ASK2000 (trade name). Thereby output was achieved at a high speed print mode. At the time of printing, line speed was 0.73 m sec/line and a maximum ultimate temperature of a TPH was 450° C.

[Evaluations]

Evaluation of Ribbon Wrinkles:

By using the sublimation printer described above, each of the heat-sensitive transfer sheets of Samples 100 to 109 and the heat-sensitive transfer image-receiving sheet S1 after they were stabilized by 24-hour standing in a room controlled to a constant temperature of 15° C. and a constant humidity of 20%, output of digital image information to be converted to a KG-size black solid print (R,G,B)=(0,0,0) was produced on 30 sheets. For quantification of ribbon wrinkles appearing as transfer defects in the 30th print, the image on the print was captured under the condition of 24-bit color and 100 dpi and converted to a data file in the bmp format as 8 bits of color information per pixel by using a network scanner ES-2200 made by Seiko Epson Corporation under control of Adobe Photoshop CS. At the time of image capture, image analysis was performed on a 98% central portion of the frame in order to remove noise information from the fringe area of the frame. The image analysis concerning ribbon wrinkles was carried out as follows: Information on R was extracted from the data file, and a dot implying 25 or more pieces of information was defined as a pixel not reproducing black color. All of such pixels were counted by use of spreadsheet software Microsoft Excel, and the total number thereof was symbolized as RS. When ribbon wrinkles are lower in number, the RS value becomes the smaller; while, when a greater number of ribbon wrinkles develop, the RS values becomes the larger.

Evaluation of Releasing Properties:

Releasing properties of each heat-sensitive transfer sheet were evaluated by noises caused by peeling the heat-sensitive transfer sheet away from the heat-sensitive transfer image-receiving sheet after the black solid print was produced in the same manner as in the evaluation of ribbon wrinkles. Evaluation criteria were as follows.

Excellent: No peeling noise was caused.

Fair: Peeling noises were caused, but there occurred no abnormal transfer.

Poor: Loud peeling noises were caused, and there occurred abnormal transfer.

Evaluation of Coating Surface Condition:

Good: Neither unevenness nor crawling in coating was perceived by visual check.

Fair: A coating had such slight unevenness and crawling as to be barely perceived or not perceived by visual check.

Poor: Unevenness and crawling in coating were clearly perceived by visual check.

TABLE 1

| Sample | Silicone | Silicone content (%) Y | M | C | Ribbon wrinkle RS | Capability of peeling off | Surface condition of coating layer | Remarks |
|---|---|---|---|---|---|---|---|---|
| 100 | X22-3000T | 0.10 | 0.10 | 0.10 | 130 | Good | Fair | Comparative example |
| 101 | " | 0.05 | 0.09 | 0.14 | 566 | Good | Poor | Comparative example |
| 102 | " | 0.10 | 0.04 | 0.16 | 1137 | Good | Poor | Comparative example |
| 103 | " | 0.06 | 0.06 | 0.06 | 65 | Poor | Good | Comparative example |
| 104 | " | 0.13 | 0.10 | 0.06 | 11 | Good | Good | Example |
| 105 | TSF4701 | 0.13 | 0.09 | 0.06 | 22 | Good | Good | Example |
| 106 | SF8427 | 0.15 | 0.09 | 0.07 | 32 | Good | Good | Example |
| 107 | CRC-7025X | 0.13 | 0.09 | 0.05 | 23 | Good | Good | Example |

From the results shown in the above table 1, it is understood that, with respect to sample 101 in which the silicone contents of the yellow, magenta and cyan heat-sensitive layers increase in this order, as compared to sample 100, ribbon wrinkles increase and the coating surface condition is not good. The samples 101 and 102 show that the occurrence of ribbon wrinkles worsen when the amounts of the silicone compound in the cyan heat-sensitive layer increase. The samples 104 to 107 in the present invention show that the occurrence of ribbon wrinkles is less compared to the sample 100.

Example 2

The similar test as in the example 1 was performed and the similar results were obtained, in this case the following heat transfer image-receiving sheet S2 and S3 were used in place of the image-receiving sheet S1 used in the example 1.

(Preparation of Heat-Transfer Image-Receiving Sheets)

Preparation of an Image-Receiving Sheet S2

A synthetic paper (trade name: Yupo FPG 200, manufactured by Yupo Corporation, thickness: 200 μm) was used as the support; and, on one surface of the support, a white intermediate layer and a receptor layer, having the following compositions, were coated in this order by a bar coater. The coating was carried out such that the amount of the white intermediate layer and the amount of the receptor layer after each layer was dried would be 1.0 g/m$^2$ and 4.0 g/m$^2$, respectively, and these layers were respectively dried at 110° C. for 30 seconds.

| White intermediate layer | |
|---|---|
| Polyester resin (Trade name: Vylon 200, manufactured by Toyobo Co., Ltd.) | 10 parts by mass |
| Fluorescent whitening agent (Trade name: Uvitex OB, manufactured by Ciba-Geigy) | 1 part by mass |
| Titanium oxide | 30 parts by mass |
| Methyl ethyl ketone/toluene (1/1, at mass ratio) | 90 parts by mass |
| **Receptor layer** | |
| Vinyl chloride/vinyl acetate resin (Trade name: Solbin A, manufactured by Nisshin Chemicals Co., Ltd.) | 100 parts by mass |
| Amino-modified silicone (Trade name: X22-3050C, manufactured by Shin-Etsu Chemical Co., Ltd.) | 5 parts by mass |
| Epoxy-modified silicone (Trade name: X22-300E, manufactured by Shin-Etsu Chemical Co., Ltd.) | 5 parts by mass |
| Methyl ethyl ketone/toluene (1/1, at mass ratio) | 400 parts by mass |

Preparation of Image-Receiving Sheet S3

A paper support, on both sides of which polyethylene was laminated, was subjected to corona discharge treatment on the surface thereof, and then a gelatin subbing layer containing sodium dodecylbenzenesulfonate was disposed on the treated surface. On the gelatin subbing layer, were multilayer-coated a heat insulation layer having the same composition as that in the image-receiving sheet S2 and an intermediate layer consisting of gelatin alone so that these layers would be superposed in this order from the support side, according to the method described in FIG. 9 of U.S. Pat. No. 2,761,791. Immediately after coating, these layers were dried at 50° C. for 16 hours. These layers were coated so that a dry coating amount of each of the heat insulation layer and the intermediate layer would become 15 g/m$^2$ and 0.2 g/m$^2$, respectively. On the intermediate layer of the thus-obtained sample, was coated a receptor layer having the same composition as that in the image-receiving sheet S2 using a bar coater. The receptor layer was coated so that a dry coating amount would become 4.0 g/m$^2$. Immediately after coating, the sample was dried at 110° C. for 30 seconds.

Having described our invention as related to the present embodiments, it is our intention that the invention not be limited by any of the details of the description, unless otherwise specified, but rather be construed broadly within its spirit and scope as set out in the accompanying claims.

I claim:

1. A heat-sensitive transfer sheet having on a support at least one thermal transfer layer of a yellow color, at least one thermal transfer layer of a magenta color, at least one thermal transfer layer of a cyan color and at least one releasable, thermally-transferable protective layer, wherein the thermal transfer layer of each color contains a release agent and contents of the release agent in the thermal transfer layers are reduced in a frame-sequential mode.

2. An image formation method in which images are formed in a state that the heat-sensitive transfer sheet as described in claim 1 is superposed upon a heat-sensitive transfer image-receiving sheet having at least one dye-receiving layer on a support.

3. The image formation method as described in claim 2, wherein the heat-sensitive transfer image-receiving sheet has at least one dye-receiving layer on a support, and further has at least one heat insulation layer containing hollow polymer particles and a hydrophilic polymer between the dye-receiving layer and the support.

4. A heat-sensitive transfer sheet having on a support at least one thermal transfer layer of a yellow color, at least one thermal transfer layer of a magenta color, at least one thermal transfer layer of a cyan color and at least one releasable, thermally-transferable protective layer in a frame-sequential mode where the thermal transfer layer of a yellow color, the thermal transfer layer of a magenta color, the thermal transfer layer of a cyan color and the thermally-transferable protective layer are aligned in order of mention, wherein release agent contents in the yellow thermal transfer layer, the magenta thermal transfer layer and the cyan thermal transfer layer become lower in order of mention.

5. An image formation method in which images are formed in a state that the heat-sensitive transfer sheet as described in claim 4 is superposed upon a heat-sensitive transfer image-receiving sheet having at least one dye-receiving layer on a support.

6. The image formation method as described in claim 5, wherein the heat-sensitive transfer image-receiving sheet has at least one dye-receiving layer on a support, and further has at least one heat insulation layer containing hollow polymer particles and a hydrophilic polymer between the dye-receiving layer and the support.

* * * * *